US011116326B2

(12) United States Patent
Jelinek et al.

(10) Patent No.: US 11,116,326 B2
(45) Date of Patent: Sep. 14, 2021

(54) MATTRESS CONTAINING ERGONOMIC AND FIRMNESS-REGULATING ENDOSKELETON

(71) Applicant: Casper Sleep Inc., New York, NY (US)

(72) Inventors: Russell Jelinek, Alameda, CA (US); Jesse Menayan, Sausalito, CA (US); David Holm, San Francisco, CA (US); Jeff Chapin, San Francisco, CA (US)

(73) Assignee: Casper Sleep Inc., New York, NY (US)

( * ) Notice: Subject to any disclaimer, the term of this patent is extended or adjusted under 35 U.S.C. 154(b) by 223 days.

(21) Appl. No.: 16/102,649

(22) Filed: Aug. 13, 2018

(65) Prior Publication Data

US 2019/0045942 A1 Feb. 14, 2019

Related U.S. Application Data

(60) Provisional application No. 62/697,871, filed on Jul. 13, 2018, provisional application No. 62/545,445, filed on Aug. 14, 2017.

(51) Int. Cl.
*A47C 27/14* (2006.01)
*A47C 27/15* (2006.01)
(Continued)

(52) U.S. Cl.
CPC ..... *A47C 27/144* (2013.01); *A47C 27/081* (2013.01); *A47C 27/085* (2013.01);
(Continued)

(58) Field of Classification Search
CPC ... A47C 27/085; A47C 27/144; A47C 27/146; A47C 27/148; A47C 27/16; A47C 27/142
See application file for complete search history.

(56) References Cited

U.S. PATENT DOCUMENTS 1,893,548 A 1/1933 Francis
2,032,248 A 2/1936 Bins
(Continued)

FOREIGN PATENT DOCUMENTS

AT 505276 B1 * 12/2008 ..... A47C 27/144
AT 15304 U1 * 5/2017 ..... A47C 27/146
(Continued)

OTHER PUBLICATIONS

Corrected Notice of Allowability dated Aug. 26, 2020 for U.S. Appl. No. 29/610,852 (pp. 1-4).
(Continued)

*Primary Examiner* — Nicholas F Polito
(74) *Attorney, Agent, or Firm* — Koffsky Schwalb LLC; Mark I. Koffsky

(57) ABSTRACT

An endoskeleton elastomer that variably impacts the mattress firmness head-to-toe is described. The elastomer fills voids cut into the foam using contour cutting or spherical cap-shaped cutouts. The elastomer is poured as a hot liquid into the voids, and cools to a solid elastomer. The specific incarnation involves the creation of a set of parallel inclusions at the center of the mattress or a set of spherical cap-shaped cutouts that help prop up the hip area to maintain proper spinal alignment by firming the center of the mattress. The depth, width, shape, spacing, elastomer durometer, and location (both head-to-toe and depth in the mattress) may be varied to impact firmness in any desired manner. The mattress may also include a series of horizontal-oriented cutouts that are cut into various portions of the mattress layers. These cutouts may extend along the width of the mattress and may be placed at portions of the top and portions of the bottom of the mattress.

18 Claims, 7 Drawing Sheets

(51) Int. Cl.
*A47C 27/16* (2006.01)
*A47C 27/08* (2006.01)

(52) U.S. Cl.
CPC ..... *A47C 27/15* (2013.01); *A47C 27/148* (2013.01); *A47C 27/16* (2013.01)

(56) References Cited

U.S. PATENT DOCUMENTS

D107,880 S 1/1938 Marsack
2,399,235 A 4/1946 Leslie
2,399,625 A 4/1946 Leslie
3,400,413 A 9/1968 La Grossa
D256,734 S 9/1980 Riley
4,407,031 A 10/1983 Michiels
4,536,906 A 8/1985 Varndell
4,542,547 A 9/1985 Sato
4,628,557 A 12/1986 Murphy
4,768,251 A 9/1988 Baskent
4,788,730 A 12/1988 Bexton
D301,412 S 6/1989 Duvivier
4,964,184 A 10/1990 Lewis
5,010,843 A 4/1991 Henry
5,023,967 A 6/1991 Ferrand
5,023,970 A 6/1991 Tesch
5,107,558 A 4/1992 Luck
5,170,522 A 12/1992 Walker
5,189,747 A 3/1993 Mundy
5,219,307 A 6/1993 Morrison
5,291,625 A 3/1994 Leslie
5,294,181 A 3/1994 Rose
5,448,788 A 9/1995 Wu
5,509,154 A 4/1996 Shafer
5,561,876 A 10/1996 Petruzella
5,564,140 A 10/1996 Shoenhair
5,642,546 A 7/1997 Shoenhair
5,652,484 A 7/1997 Shafer
D383,028 S 9/1997 Pierce
5,730,120 A 3/1998 Yonkers, Jr.
5,765,246 A 6/1998 Shoenhair
5,903,941 A 5/1999 Shafer
5,904,172 A 5/1999 Gifft
D411,057 S 6/1999 Johnson
6,037,723 A 3/2000 Shafer
6,061,856 A 5/2000 Hoffmann
6,108,843 A 8/2000 Suzuki
6,115,861 A 9/2000 Reeder
D431,730 S 10/2000 Zorzetto
6,175,890 B1 1/2001 Yamaura
6,175,980 B1 1/2001 Gaither
6,192,538 B1 2/2001 Fogel
6,196,157 B1 3/2001 Northrop
6,202,239 B1 3/2001 Ward
6,212,718 B1 4/2001 Stolpmann
6,286,167 B1 9/2001 Stolpmann
6,301,730 B1 10/2001 Delfs
6,305,317 B1 10/2001 Spiegel
6,336,237 B1 1/2002 Schmid
6,397,419 B1 6/2002 Mechache
6,421,859 B1 7/2002 Hicks
6,483,264 B1 11/2002 Shafer
6,546,576 B1 4/2003 Lin
6,557,198 B1 5/2003 Gladney
6,658,683 B2 12/2003 Parvin
D486,665 S 2/2004 Weaver
D486,877 S 2/2004 Peterson
D486,969 S 2/2004 WEaver
6,686,711 B2 2/2004 Rose
D487,207 S 3/2004 Manuel
6,708,357 B2 3/2004 Gaboury
6,763,541 B2 7/2004 Mahoney
6,804,848 B1 10/2004 Rose
6,807,698 B2 10/2004 Torbet
6,832,397 B2 12/2004 Gaboury
6,854,143 B2 2/2005 Sharples
6,883,191 B2 4/2005 Gaboury
6,895,620 B1 5/2005 Rensink
6,931,685 B2 8/2005 Kuchel
6,952,850 B2 10/2005 Visser
6,971,128 B1 12/2005 McGrath
6,983,500 B2 1/2006 Wootten
7,036,172 B2 * 5/2006 Torbet ..... A47C 27/082 5/713
7,036,173 B2 5/2006 Gladney
D525,740 S 7/2006 Parker
D526,140 S 8/2006 Cook
7,103,933 B2 9/2006 Gladney
7,147,538 B2 12/2006 Cano
7,155,766 B1 1/2007 Gilchrest, Jr.
7,165,281 B2 1/2007 Larssson
D551,704 S 9/2007 Nakamura
D564,239 S 3/2008 Mecchi
D581,713 S 12/2008 Berke
7,530,127 B2 5/2009 Leifermann
D593,349 S 6/2009 Pittman
7,614,362 B2 11/2009 Dunn
D605,337 S 12/2009 Zhang
D608,560 S 1/2010 Chen
D608,561 S 1/2010 Chen
D608,562 S 1/2010 Chen
7,788,750 B2 9/2010 Norstrem
D629,150 S 12/2010 Douloubakas
D634,148 S 3/2011 Morrison
7,908,687 B2 3/2011 Ward
7,914,611 B2 3/2011 Vrzalik
7,921,807 B2 4/2011 Arvanites
7,937,789 B2 5/2011 Feher
7,950,084 B1 5/2011 Mckay
D639,492 S 6/2011 Lee
8,051,514 B2 11/2011 Yarmer
8,065,763 B2 11/2011 Brykalski
8,118,920 B2 2/2012 Vrzalik
D657,150 S 4/2012 Hughes
D658,412 S 5/2012 Hoyord
8,181,290 B2 5/2012 Brykalski
D663,077 S 7/2012 Pohl
D664,303 S 7/2012 Chauncey
8,245,339 B2 8/2012 Murray
8,256,236 B2 9/2012 Lofy
8,307,482 B2 11/2012 Gladney
8,336,369 B2 12/2012 Mahoney
D674,644 S 1/2013 Stewart
D675,855 S 2/2013 Reeves
8,372,182 B2 2/2013 Vrzalik
8,402,578 B2 3/2013 Ko
D679,870 S 4/2013 Williams
8,448,315 B2 5/2013 Rensink
8,490,233 B2 7/2013 Essers
8,512,854 B2 8/2013 Fox
D694,746 S 12/2013 Akana
D696,044 S 12/2013 Robilotto
8,621,687 B2 1/2014 Brykalski
D699,983 S 2/2014 Polesuk
8,672,842 B2 3/2014 Kenalty
D702,971 S 4/2014 Mitchell
D702,972 S 4/2014 Busch
8,739,339 B1 6/2014 Mckay
8,745,784 B2 6/2014 Cole
8,745,795 B2 6/2014 Klancnik
8,769,747 B2 7/2014 Mahoney
8,789,224 B2 7/2014 Wyatt
8,800,979 B2 8/2014 Defranks
D713,165 S 9/2014 Robinson
8,832,888 B2 9/2014 Chunglo
8,863,336 B2 10/2014 Theosabrata
8,881,328 B2 11/2014 Mikkelsen
D720,157 S 12/2014 Villena
8,918,930 B2 12/2014 Stroh
8,931,329 B2 1/2015 Mahoney
8,933,140 B2 1/2015 Peterson
D722,239 S 2/2015 Russell
8,959,683 B2 2/2015 Rochlin
D723,304 S 3/2015 Chang
D724,254 S 3/2015 Sun
D725,832 S 3/2015 Coulter

(56) References Cited

U.S. PATENT DOCUMENTS

| | | | |
|---|---|---|---|
| 8,966,689 | B2 | 3/2015 | McGuire |
| 8,973,183 | B1 | 3/2015 | Palashewski |
| 8,984,687 | B2 | 3/2015 | Stusynski |
| 8,984,690 | B2 | 3/2015 | Chunglo |
| 8,997,279 | B1 | 4/2015 | Mckay |
| 9,009,898 | B2 | 4/2015 | Morimura |
| D728,254 | S | 5/2015 | Karnes-Toth |
| D728,271 | S | 5/2015 | Cohen |
| D731,209 | S | 6/2015 | Fux |
| 9,085,125 | B2 | 7/2015 | Gesquière |
| D736,537 | S | 8/2015 | Grossman |
| 9,095,224 | B2 | 8/2015 | Tanaka |
| 9,119,478 | B2 | 9/2015 | Defranks |
| 9,125,497 | B2 | 9/2015 | Brykalski |
| 9,138,064 | B2 | 9/2015 | Tursi, Jr. |
| 9,186,479 | B1 | 11/2015 | Franceschetti |
| 9,192,245 | B2 | 11/2015 | Chunglo |
| 9,204,731 | B2 | 12/2015 | Corodemus |
| 9,204,732 | B2 | 12/2015 | Wyatt |
| 9,211,017 | B2 | 12/2015 | Tyree |
| D747,899 | S | 1/2016 | Klein |
| 9,259,099 | B1 | 2/2016 | Larsen |
| 9,265,352 | B2 | 2/2016 | Oakhill |
| 9,271,579 | B2 | 3/2016 | Riley |
| 9,326,903 | B2 | 5/2016 | Locke |
| 9,326,904 | B2 | 5/2016 | Nomura |
| 9,370,457 | B2 | 6/2016 | Nunn |
| 9,386,862 | B1 | 7/2016 | Limer |
| 9,392,875 | B2 | 7/2016 | Weyl |
| 9,392,879 | B2 | 7/2016 | Nunn |
| D766,017 | S | 9/2016 | Jensen |
| 9,445,751 | B2 | 9/2016 | Young |
| 9,474,384 | B2 | 10/2016 | Rawls-Meehan |
| D770,672 | S | 11/2016 | Ju |
| 9,504,332 | B2 | 11/2016 | Gladney |
| D773,209 | S | 12/2016 | Jaigobin |
| 9,510,688 | B2 | 12/2016 | Nunn |
| 9,510,698 | B1 | 12/2016 | Krotova |
| D776,960 | S | 1/2017 | Suzuki |
| 9,538,853 | B2 | 1/2017 | Vrzalik |
| 9,538,855 | B2 | 1/2017 | Gross |
| D778,637 | S | 2/2017 | Barry |
| D779,856 | S | 2/2017 | Rich |
| 9,578,941 | B2 | 2/2017 | Maclachlan |
| D781,078 | S | 3/2017 | Goenka |
| 9,597,244 | B2 | 3/2017 | Ishibashi |
| 9,609,951 | B2 | 4/2017 | Chan |
| 9,622,589 | B2 | 4/2017 | Nomura |
| D785,370 | S | 5/2017 | Randall |
| D785,968 | S | 5/2017 | Burden |
| 9,635,953 | B2 | 5/2017 | Nunn |
| 9,642,472 | B2 | 5/2017 | Gladney |
| 9,657,800 | B2 | 5/2017 | Defranks |
| D790,257 | S | 6/2017 | Holbrook |
| D791,494 | S | 7/2017 | Bosch |
| 9,694,156 | B2 | 7/2017 | Franceschetti |
| 9,730,524 | B2 | 8/2017 | Chen |
| 9,737,150 | B2 | 8/2017 | Rawls-Meehan |
| 9,737,154 | B2 | 8/2017 | Mahoney |
| D796,725 | S | 9/2017 | Recker |
| D798,077 | S | 9/2017 | Schmitt |
| 9,770,114 | B2 | 9/2017 | Brosnan |
| 9,770,117 | B1 * | 9/2017 | Torbet ..... A47C 27/146 |
| D799,858 | S | 10/2017 | Pearce |
| 9,782,311 | B2 | 10/2017 | Lafleche |
| 9,788,661 | B1 | 10/2017 | Alletto |
| D802,324 | S | 11/2017 | Bucove |
| D804,856 | S | 12/2017 | Desodt |
| 9,844,275 | B2 | 12/2017 | Nunn |
| 9,861,208 | B2 | 1/2018 | Carlitz |
| D809,321 | S | 2/2018 | Bell |
| D809,843 | S | 2/2018 | Keeley |
| D810,458 | S | 2/2018 | Cartier |
| 9,888,782 | B1 | 2/2018 | Jannke |
| D812,393 | S | 3/2018 | Karschnik |
| D812,643 | S | 3/2018 | Akana |
| 9,907,408 | B2 | 3/2018 | Vrzalik |
| 9,918,558 | B2 | 3/2018 | Limer |
| D815,335 | S | 4/2018 | Lin |
| 9,930,971 | B2 | 4/2018 | Dóczi |
| 9,931,085 | B2 | 4/2018 | Young |
| 9,949,573 | B1 | 4/2018 | Huang |
| 9,962,902 | B2 | 5/2018 | Losio |
| D822,911 | S | 7/2018 | Menayan |
| 10,016,064 | B2 | 7/2018 | Corodemus |
| D824,698 | S | 8/2018 | Pennington |
| 10,051,973 | B2 | 8/2018 | Morgan |
| 10,058,467 | B2 | 8/2018 | Stusynski |
| 10,092,242 | B2 | 10/2018 | Nunn |
| 10,105,092 | B2 | 10/2018 | Franceschetti |
| 10,136,735 | B2 | 11/2018 | Ocegueda |
| D836,849 | S | 12/2018 | Romaya |
| 10,143,312 | B2 | 12/2018 | Brosnan |
| 10,149,549 | B2 | 12/2018 | Erko |
| 10,154,932 | B2 | 12/2018 | Franceschetti |
| 10,179,526 | B2 | 1/2019 | Marquette |
| 10,182,661 | B2 | 1/2019 | Nunn |
| D840,732 | S | 2/2019 | Karschnik |
| 10,194,752 | B2 | 2/2019 | Zaiss |
| 10,194,753 | B2 | 2/2019 | Fleury |
| 10,201,234 | B2 | 2/2019 | Nunn |
| 10,202,499 | B2 | 2/2019 | Crawford |
| D843,418 | S | 3/2019 | Demin |
| 10,251,490 | B2 | 4/2019 | Nunn |
| D848,051 | S | 5/2019 | Huang |
| 10,285,508 | B2 | 5/2019 | Rose |
| D850,161 | S | 6/2019 | Ping |
| D850,682 | S | 6/2019 | DeBrunner |
| 10,314,407 | B1 | 6/2019 | Main |
| 10,342,358 | B1 | 7/2019 | Palashewski |
| 10,357,113 | B2 | 7/2019 | Gladney |
| 10,357,115 | B2 | 7/2019 | Oh |
| D857,433 | S | 8/2019 | Negus |
| D860,257 | S | 9/2019 | Akana |
| D861,227 | S | 9/2019 | Sonneman |
| D861,964 | S | 10/2019 | Lin |
| D862,104 | S | 10/2019 | Suzuki |
| D862,105 | S | 10/2019 | Liu |
| D863,356 | S | 10/2019 | Akana |
| D864,615 | S | 10/2019 | Morrison |
| 10,441,086 | B2 | 10/2019 | Nunn |
| 10,441,087 | B2 | 10/2019 | Karschnik |
| 10,448,749 | B2 | 10/2019 | Palashewski |
| D865,402 | S | 11/2019 | Morrison |
| 10,463,165 | B2 | 11/2019 | Ishibashi |
| 10,470,583 | B2 | 11/2019 | Gross |
| 10,477,975 | B2 | 11/2019 | Tursi, Jr. |
| 10,492,969 | B2 | 12/2019 | Stusynski |
| 10,531,745 | B2 | 1/2020 | Chen |
| 10,539,170 | B2 | 1/2020 | Griffith |
| D885,077 | S | 5/2020 | Kamler |
| 2001/0027334 | A1 | 10/2001 | White |
| 2001/0029628 | A1 | 10/2001 | Ferrand |
| 2002/0069462 | A1 | 6/2002 | Gaboury |
| 2003/0181538 | A1 | 9/2003 | Martel |
| 2003/0233706 | A1 | 12/2003 | Birch |
| 2004/0134433 | A1 | 7/2004 | Holder |
| 2004/0154101 | A1 | 8/2004 | DiGirolamo |
| 2005/0087142 | A1 | 4/2005 | Dalal |
| 2005/0210595 | A1 | 9/2005 | Di Stasio |
| 2005/0224000 | A1 | 10/2005 | Holte |
| 2006/0042008 | A1 | 3/2006 | Baker |
| 2006/0046024 | A1 | 3/2006 | Huntley |
| 2006/0053560 | A1 | 3/2006 | Metzger |
| 2006/0053561 | A1 | 3/2006 | Metzger |
| 2006/0085919 | A1 | 4/2006 | Kramer |
| 2006/0254526 | A1 | 11/2006 | Andriola |
| 2006/0272582 | A1 | 12/2006 | Dunn |
| 2007/0040424 | A1 | 2/2007 | Neustat |
| 2007/0101496 | A1 | 5/2007 | Ho |
| 2007/0107133 | A1 | 5/2007 | Schwaiger |
| 2007/0226911 | A1 | 10/2007 | Gladney |
| 2007/0256241 | A1 | 11/2007 | Harmon |
| 2007/0273539 | A1 | 11/2007 | Gananathan |

(56) References Cited

U.S. PATENT DOCUMENTS

2008/0010746 A1 1/2008 Ho
2008/0010751 A1 1/2008 Kemper
2008/0028536 A1 2/2008 Hadden-Cook
2008/0052830 A1 3/2008 Koughan
2008/0116403 A1 5/2008 Shelbourn
2008/0127897 A1 6/2008 Flannery
2008/0127898 A1 6/2008 Morse
2008/0127899 A1 6/2008 Angus
2008/0155755 A1 7/2008 Crousore
2008/0173627 A1 7/2008 Martin
2008/0201856 A1 8/2008 Howard
2008/0313815 A1 12/2008 Guesquiere
2009/0000031 A1 1/2009 Feher
2009/0089933 A1 4/2009 Letton
2009/0106894 A1 4/2009 Yeo
2009/0127912 A1 5/2009 Galbreath
2009/0151072 A1 6/2009 Jones, III
2009/0172881 A1 7/2009 Peterson
2009/0217459 A1 9/2009 Rudolph
2010/0038882 A1 2/2010 Chimento
2010/0050341 A1 3/2010 Tepper
2010/0058541 A1 3/2010 Kemper
2010/0087561 A1 4/2010 Abraham
2010/0160473 A1 6/2010 Neff
2010/0205738 A1 8/2010 Pollack
2010/0237082 A1 9/2010 Fernandez
2010/0269262 A1 10/2010 Warren
2010/0313356 A1 12/2010 Morter
2011/0035879 A1* 2/2011 Grinstead ..... A47C 21/046 5/421
2011/0061168 A1 3/2011 Farley
2011/0067183 A1* 3/2011 Hawkins ..... B32B 5/32 5/740
2011/0099722 A1 5/2011 Moret
2011/0107514 A1 5/2011 Brykalski
2011/0115635 A1 5/2011 Petrovski
2011/0154576 A1* 6/2011 Warren ..... A47C 27/144 5/740
2011/0173757 A1 7/2011 Rensink
2011/0252572 A1* 10/2011 Morrison ..... A47C 27/144 5/740
2011/0290834 A1 12/2011 Pelz
2011/0314605 A1 12/2011 Deguchi
2012/0001548 A1 1/2012 Recker
2012/0053423 A1 3/2012 Kenalty
2012/0060284 A1 3/2012 Caines
2012/0110734 A1 5/2012 An
2012/0159715 A1 6/2012 Jung
2012/0180225 A1 7/2012 Gladney
2012/0324646 A1 12/2012 Briganti
2013/0025050 A1 1/2013 Syrowitz
2013/0025070 A1 1/2013 Ruehlmann
2013/0042411 A1 2/2013 Vitale
2013/0146211 A1 6/2013 Mason
2013/0152305 A1 6/2013 Lall
2013/0174344 A1 7/2013 Klancnik
2013/0175057 A1 7/2013 Klancnik
2013/0180050 A1 7/2013 Koci
2013/0247828 A1 9/2013 Tedaldi
2013/0263377 A1 10/2013 Wootten, Jr.
2013/0263386 A1 10/2013 Romero
2013/0284099 A1 10/2013 Oakes, Jr.
2014/0033440 A1 2/2014 Tyree
2014/0033441 A1 2/2014 Morgan
2014/0039082 A1 2/2014 Peterson
2014/0059765 A1 3/2014 Harris
2014/0068868 A1 3/2014 Morzano
2014/0082843 A1 3/2014 Papadakos
2014/0082846 A1 3/2014 Blazar
2014/0099468 A1 4/2014 Cai
2014/0109314 A1 4/2014 Boersma
2014/0109320 A1 4/2014 Chunglo
2014/0130255 A1 5/2014 Montano, Jr.
2014/0141233 A1 5/2014 Crawford
2014/0182061 A1 7/2014 Zaiss
2014/0189955 A1 7/2014 Alletto, Jr.
2014/0190417 A1 7/2014 Lipscomb
2014/0201925 A1 7/2014 Tursi, Jr.
2014/0227552 A1 8/2014 Lau
2014/0230735 A1 8/2014 Coulter
2014/0250596 A1 9/2014 De La Place
2014/0259433 A1 9/2014 Nunn
2014/0277822 A1 9/2014 Nunn
2014/0283303 A1 9/2014 Rochlin
2014/0283308 A1 9/2014 Chen
2015/0000042 A1 1/2015 Randall
2015/0007393 A1 1/2015 Palashewski
2015/0026896 A1 1/2015 Fleury
2015/0067967 A1 3/2015 Tyree
2015/0074911 A1 3/2015 Dungan
2015/0082545 A1 3/2015 Holbrook
2015/0135435 A1 5/2015 Ueda
2015/0182032 A1 7/2015 Jensen
2015/0182397 A1 7/2015 Palashewski
2015/0182399 A1 7/2015 Rose
2015/0208819 A1 7/2015 Mckay
2015/0237824 A1 8/2015 Cantwell
2015/0290059 A1 10/2015 Brosnan
2015/0296995 A1 10/2015 Krim
2015/0351556 A1 12/2015 Franceschetti
2015/0351982 A1 12/2015 Krenik
2015/0366366 A1 12/2015 Zaiss
2016/0015184 A1 1/2016 Nunn
2016/0037938 A1 2/2016 Tyree
2016/0073788 A1 3/2016 Franceschetti
2016/0073950 A1 3/2016 Franceschetti
2016/0081487 A1 3/2016 Corodemus
2016/0100696 A1 4/2016 Palashewski
2016/0106061 A1 4/2016 Nelson
2016/0128487 A1 5/2016 Eskridge, III
2016/0128488 A1 5/2016 Franceschetti
2016/0135623 A1 5/2016 Montzka
2016/0157625 A1 6/2016 Schneider
2016/0169490 A1 6/2016 Kijima
2016/0183691 A1 6/2016 Mason
2016/0192617 A1 7/2016 Murphy
2016/0192786 A1 7/2016 Holbrook
2016/0224750 A1 8/2016 Kethman
2016/0242562 A1 8/2016 Karschnik
2016/0262557 A1 9/2016 Williams
2016/0296031 A1 10/2016 Sramek
2016/0309678 A1 10/2016 Garnet
2016/0338871 A1 11/2016 Nunn
2016/0360905 A1 12/2016 Feldman
2017/0003666 A1 1/2017 Nunn
2017/0028165 A1 2/2017 Franceschetti
2017/0035212 A1 2/2017 Erko
2017/0112292 A1 4/2017 Sopher
2017/0135632 A1 5/2017 Franceschetti
2017/0135881 A1 5/2017 Franceschetti
2017/0135882 A1 5/2017 Franceschetti
2017/0135883 A1 5/2017 Franceschetti
2017/0172240 A1 6/2017 Massey
2017/0191516 A1 7/2017 Griffith
2017/0196369 A1 7/2017 Nunn
2017/0208955 A1 7/2017 Lee
2017/0231401 A1 8/2017 McGuire
2017/0238715 A1 8/2017 Choi
2017/0251839 A1 9/2017 McLeod
2017/0259028 A1 9/2017 Franceschetti
2017/0273470 A1 9/2017 Brykalski
2017/0295945 A1 10/2017 Stickler
2017/0296412 A1 10/2017 Hung
2017/0296773 A1 10/2017 Franceschetti
2017/0318980 A1 11/2017 Mahoney
2017/0318981 A1 11/2017 Duwell
2017/0348182 A1 12/2017 Yoo
2017/0354268 A1 12/2017 Brosnan
2018/0027981 A1 2/2018 Sherman
2018/0042393 A1 2/2018 Alletto
2018/0042400 A1 2/2018 Lin
2018/0100254 A1 4/2018 Brunton
2018/0116415 A1 5/2018 Karschnik
2018/0125259 A1 5/2018 Peterson

(56) References Cited

U.S. PATENT DOCUMENTS

| | | | | |
|---|---|---|---|---|
| 2018/0125260 | A1 | 5/2018 | Peterson | |
| 2018/0153766 | A1 | 6/2018 | Chen | |
| 2018/0271300 | A1 | 9/2018 | Wang | |
| 2018/0289171 | A1 | 10/2018 | Alletto, Jr. | |
| 2018/0344041 | A1 | 12/2018 | Liu | |
| 2019/0021513 | A1 | 1/2019 | Nunn | |
| 2019/0029597 | A1 | 1/2019 | Nunn | |
| 2019/0082855 | A1 | 3/2019 | Brosnan | |
| 2019/0099017 | A1 | 4/2019 | Goldberg | |
| 2019/0104858 | A1 | 4/2019 | Erko | |
| 2019/0125097 | A1 | 5/2019 | Nunn | |
| 2019/0133332 | A1 | 5/2019 | Zaiss | |
| 2019/0174930 | A1 | 6/2019 | Defranks | |
| 2019/0186704 | A1 | 6/2019 | Qiu | |
| 2019/0223630 | A1 | 7/2019 | Phan | |
| 2019/0230434 | A1 | 7/2019 | Stanley | |
| 2019/0231084 | A1 | 8/2019 | Nunn | |
| 2019/0254438 | A1 | 8/2019 | Rose | |
| 2019/0254593 | A1 | 8/2019 | Franceschetti | |
| 2019/0269878 | A1 | 9/2019 | Franceschetti | |
| 2019/0274443 | A1* | 9/2019 | Chan | A47C 27/146 |
| 2019/0320809 | A1 | 10/2019 | Ishibashi | |
| 2019/0321581 | A1 | 10/2019 | Franceschetti | |
| 2019/0328147 | A1 | 10/2019 | Palashewski | |
| 2019/0343306 | A1 | 11/2019 | Muthanandam | |
| 2019/0357696 | A1 | 11/2019 | Palashewski | |
| 2019/0376945 | A1 | 12/2019 | Yao | |
| 2020/0029704 | A1 | 1/2020 | Karschnik | |
| 2020/0113343 | A1 | 4/2020 | Staels | |

FOREIGN PATENT DOCUMENTS

| | | | | |
|---|---|---|---|---|
| CA | 2044355 | C | 1/1995 | |
| CA | 20543490 | | 3/1995 | |
| CA | 2112895 | C | 8/1998 | |
| CA | 2305522 | A1 | 4/1999 | |
| CA | 2416861 | A1 | 8/2003 | |
| CA | 2502697 | A1 | 4/2004 | |
| CA | 2525570 | C | 11/2006 | |
| CA | 2650218 | A1 | 11/2007 | |
| CA | 2922187 | A1 | 11/2007 | |
| CA | 2989606 | A1 | 3/2010 | |
| CA | 2754914 | A1 | 9/2010 | |
| CA | 2618630 | C | 10/2011 | |
| CA | 2799927 | A1 | 12/2011 | |
| CA | 2801789 | A1 | 12/2011 | |
| CA | 2823387 | A1 | 7/2012 | |
| CA | 2783753 | A1 | 1/2013 | |
| CA | 2783982 | A1 | 1/2013 | |
| CA | 2843370 | A1 | 1/2013 | |
| CA | 2848770 | A1 | 3/2013 | |
| CA | 2855227 | A1 | 4/2013 | |
| CA | 2651960 | C | 7/2013 | |
| CA | 2800552 | A1 | 7/2013 | |
| CA | 2878994 | A1 | 3/2014 | |
| CA | 2888119 | A1 | 5/2014 | |
| CA | 2894194 | A1 | 6/2014 | |
| CA | 2839603 | A1 | 7/2014 | |
| CA | 2648272 | C | 1/2015 | |
| CA | 2863889 | A1 | 3/2015 | |
| CA | 2922738 | A1 | 3/2015 | |
| CA | 2937238 | A1 | 7/2015 | |
| CA | 2963626 | A1 | 4/2016 | |
| CA | 2744772 | C | 5/2016 | |
| CA | 2876788 | A1 | 7/2016 | |
| CA | 2978341 | A1 | 10/2016 | |
| CA | 2956830 | A1 | 8/2017 | |
| CA | 2958348 | A1 | 8/2017 | |
| CA | 2940763 | C | 10/2017 | |
| CA | 2740802 | C | 1/2018 | |
| CA | 2770105 | C | 1/2018 | |
| CA | 2737749 | C | 2/2018 | |
| CN | 2071915 | U | 2/1991 | |
| CN | 2633118 | Y | 8/2004 | |
| CN | 2636734 | Y | 9/2004 | |
| CN | 2840811 | Y | 11/2006 | |
| CN | 101138457 | A | 3/2008 | |
| CN | 201341650 | Y | 11/2009 | |
| CN | 201379320 | | 1/2010 | |
| CN | 201452382 | U | 5/2010 | |
| CN | 201727183 | U | 2/2011 | |
| CN | 201996026 | U | 10/2011 | |
| CN | 202014890 | U | 10/2011 | |
| CN | 202136017 | U | 2/2012 | |
| CN | 102822224 | | 12/2012 | |
| CN | 202604242 | U | 12/2012 | |
| CN | 203016383 | U | 6/2013 | |
| CN | 203328338 | | 12/2013 | |
| CN | 205548120 | U | 9/2016 | |
| CN | 106617913 | A | 5/2017 | |
| CN | 107307672 | A | 11/2017 | |
| CN | 107432611 | A | 12/2017 | |
| CN | 107455989 | A | 12/2017 | |
| DE | 7037476 | U | 5/1971 | |
| DE | 2708068 | A1 | 9/1978 | |
| DE | 10238457 | A1 | 3/2004 | |
| DE | 10300169 | A1 | 7/2004 | |
| DE | 10311434 | | 9/2004 | |
| DE | 202005016938 | U1 | 3/2007 | |
| DE | 102007021312 | A1 | 11/2008 | |
| DE | 102009044308 | A1 | 4/2011 | |
| DE | 202010017223 | U1 | 8/2011 | |
| DE | 102008055549 | B4 | 7/2014 | |
| DE | 102010048357 | B4 | 2/2017 | |
| DE | 112015005896 | T5 | 9/2017 | |
| DE | 102017117556 | A1 * | 2/2019 | A47C 27/144 |
| EP | 1011391 | B1 | 10/2002 | |
| EP | 1457139 | A1 | 9/2004 | |
| EP | 1670338 | A1 | 6/2006 | |
| EP | 1951089 | A2 | 8/2008 | |
| EP | 1793707 | B1 | 10/2008 | |
| EP | 1339369 | B1 | 1/2010 | |
| EP | 2140847 | A2 | 1/2010 | |
| EP | 1648269 | B1 | 11/2010 | |
| EP | 2263498 | A2 | 12/2010 | |
| EP | 2280627 | B1 | 10/2011 | |
| EP | 2341800 | B1 | 11/2012 | |
| EP | 2532278 | A1 | 12/2012 | |
| EP | 2532281 | A1 | 12/2012 | |
| EP | 2393399 | B1 | 3/2013 | |
| EP | 2764799 | A2 | 8/2014 | |
| EP | 1261265 | B1 | 7/2015 | |
| EP | 2957191 | A1 | 12/2015 | |
| EP | 2369959 | B1 | 8/2016 | |
| ES | 2201183 | T3 | 3/2004 | |
| ES | 2534286 | T3 | 4/2015 | |
| ES | 2535762 | R1 | 6/2015 | |
| ES | 2535762 | B1 | 4/2016 | |
| FR | 2473291 | A1 * | 7/1981 | A47C 27/144 |
| FR | 2622683 | A1 | 5/1989 | |
| FR | 2641455 | A1 | 7/1990 | |
| FR | 2715550 | A1 | 8/1995 | |
| FR | 2759304 | A1 | 8/1998 | |
| FR | 2835164 | A3 | 8/2003 | |
| GB | 1572763 | | 8/1980 | |
| GB | 2369569 | | 6/2002 | |
| GB | 2458892 | B | 11/2012 | |
| JP | H05123231 | A | 5/1993 | |
| JP | H05146345 | A | 6/1993 | |
| JP | 2002253388 | A | 9/2002 | |
| JP | 2004329706 | | 11/2004 | |
| JP | 2005000192 | | 1/2005 | |
| JP | 2005160794 | A | 6/2005 | |
| JP | 2014023967 | A | 2/2014 | |
| JP | 6383771 | B2 * | 8/2018 | A47C 27/15 |
| KR | 20110132025 | A | 12/2011 | |
| KR | 101465852 | B1 | 11/2014 | |
| KR | 101581722 | B1 | 1/2016 | |
| KR | 20180031449 | A | 3/2018 | |
| RU | 2607426 | C1 | 1/2017 | |
| WO | 2000002516 | A1 | 1/2000 | |
| WO | 2005032310 | | 4/2005 | |
| WO | 2007060371 | A2 | 5/2007 | |
| WO | 2013157534 | | 10/2013 | |

(56) References Cited

FOREIGN PATENT DOCUMENTS

| | | | |
|---|---|---|---|
| WO | 2014105687 | | 7/2014 |
| WO | 2016182795 | A1 | 11/2016 |
| WO | 2016182858 | A1 | 11/2016 |
| WO | 2017213732 | A1 | 12/2017 |
| WO | 2018089464 | A1 | 5/2018 |
| WO | 2019089830 | A1 | 5/2019 |

OTHER PUBLICATIONS

Dodow "Product Guide" purchased 2018 (13 pages).
Fivefive S.A.S. "HOLI The Little Book to Sleep and Wake Up Bright" purchased in 2018 (6 pages).
Fivefive S.A.S. "Manual Multilanguage v2.1" Copyright 2013 (7 pages).
General Electric Company "C-Sleep" product packaging Purchase date unknown (2 pages).
General Electric Company Product Guide for GE Sol Lamp purchased 2018 (9 pages).
International Search Report and Written Opinion for App. No. PCT/US2020/043712, dated Oct. 14, 2020, 17 pages.
International Search Report, Written Opinion of ISA, PCT/US2019/12582 (dated Apr. 25, 2019) (14 pages).
Koninklijke Philips N.V. "Philips HealWell White paper" 2014 (12 pages).
Koninklijke Philips N.V. "Philips Lighting University—Connecting LEDs A Quick Reference Guide" 2014 (77 pages).
Lighting Science "Awake & Alert Biological lights" LED-product packaging Purchase date unknown (3 pages).
Notice of Allowance dated Apr. 2, 2020, for U.S. Appl. No. 29/667,664 (pp. 1-5).
Notice of Allowance dated Apr. 30, 2020 for U.S. Appl. No. 29/667,664 (pp. 1-4).
Notice of Allowance dated Jul. 2, 2020 for U.S. Appl. No. 15/677,387 (pp. 1-9).
Notice of Allowance dated Jul. 29, 2020 for U.S. Appl. No. 29/610,852 (pp. 1-7).
NOX "User Manual for Smart Sleep Light Sleepace" received in 2018 (12 pages).
Office Action dated Feb. 10, 2020, for U.S. Appl. No. 16/241,665 (pp. 1-10).
Office Action dated Nov. 29, 2019 for U.S. Appl. No. 29/667,664 (pp. 1-7).
Office Action dated Oct. 15, 2020 for U.S. Appl. No. 16/390,194 (pp. 1-24).
Office Action dated Oct. 5, 2020 for U.S. Appl. No. 16/241,665 (pp. 1-13).
Pablo Design "UMA Setup Guide & Owners Manual" purchased 2017 (8 pages).
Philips "Hue Personal Wireless Lighting Get started with Philips Hue" brochure purchased 2017 (6 pages).
Philips "Hue Personal Wireless Lighting" pamphlet Purchased 2017 (2 pages).
Philips "Wake-up Light" product packaging Purchase date unknown (1 page).
Philips Lighting Holding B.V. "Hue Personal Wireless Lighting" product packaging 2016 (2 pages).
Philips Lighting Holding B.V. "User manual" Jan. 30, 2017 (2 pages).
Twist Product Guide purchased 2017 (2 pages).
Up Light Corp. "Smart Wake UP Light" product packaging Purchase date unknown (2 pages).
Wout van Bommel, at al., Koninklijke Philips Electronics N.V. "Lighting Hardware" Copyright 2011 (107 pages).
International Search Report and Written Opinion for Application No. PCT/US19/28543, dated Aug. 22, 2019, 16 pages.
Notice of Allowance dated Jul. 12, 2019 for U.S. Appl. No. 29/641,393 (pp. 1-10).
The Casper Mattress, casper.com/mattresses/casper/, retrieved Aug. 27, 2019, 29 pages.
The Essential Mattress, casper.com/mattresses/casper-essential/, retrieved Aug. 27, 2019, 15 pages.
The Wave Mattress, casper.com/mattresses/casper-wave/, retrieved Aug. 27, 2019, 30 pages.
Canadian Patent Application No. 2,909,804, Office Action dated Oct. 18, 2019, 4 pages.
Office Action dated Apr. 9, 2020, for U.S. Appl. No. 29/610,852 (pp. 1-6).
Office Action dated Dec. 2, 2019 for U.S. Appl. No. 29/610,852 (pp. 1-7).
Office Action dated Mar. 16, 2020, for U.S. Appl. No. 15/677,387 (pp. 1-20).
Office Action dated May 6, 2020 for U.S. Appl. No. 15/872,737 (pp. 1-10).
Office Action dated Nov. 15, 2019 for U.S. Appl. No. 29/610,695 (pp. 1-7).
Office Action dated Nov. 15, 2019 for U.S. Appl. No. 29/610,820 (pp. 1-6).
Office Action dated Nov. 18, 2019 for U.S. Appl. No. 29/610,826 (pp. 1-7).
International Search Report and Written Opinion for PCT/US18/46573 dated Oct. 22, 2013, 23 pages.
Office Action dated Mar. 20, 2019 for U.S. Appl. No. 15/611,902 (pp. 1-16).
Japanese Office Action (with English language translation for Application No. 2017-507687, dated Apr. 2, 2019, 9 pages.
International Search Report and Written Opinion for PCT/US197/13582, dated Apr. 25, 2019, 14 pages.
International Search Report, Written Opinion of ISA and Search History, PCT/US2015/026564, dated Aug. 31, 2015. (19 pages).
Communication from Thomas Petr received in PCT/US2015/026564, dated Feb. 27, 2016. (1 page).
Supplementary Partial European Search Report for EP 15 78 3835 (dated Nov. 14, 2017) (14 pages).
Dormia Website Existing at Least as Early as Jun. 14, 2008. (2 pages).
Specification and Build Sheet for Dormia Radiance Mattress dated Jun. 14, 2007. (2 pages).
Correspondence Regarding Distribution of Dormia Radiance Mattress, Authored by Classic Brands, LLC, dated Nov. 1, 2007. (1 pg).
Casper Pillow review. Sleepopolis. Published on Jan. 22, 2016. Website found at: https://www.youtube.com/watch?v=h4AhiXbEO3U. (15 pages).
Third-Party Submission Under 37 CFR 1.290 dated Jun. 14, 2016 in U.S. Appl. No. 14/689,945. (15 pages).
Third-Party Submission Under 37 CFR 1.290 dated Jun. 27, 2016 in U.S. Appl. No. 14/689,945. (11 pages).
Third-Party Submission under 37 CFR 1.290 dated Jun. 10, 2016 in U.S. Appl. No. 14/689,945. (9 pages).
Chewy Casper Memory Foam Dog Bed Aug. 28, 2017 [site visited Jan. 23, 2018] Available from Internet URL: <https://www.chewy.com/casper-memory-foam-dog-bed-medium/dp/155149>—(7 pages).
Groupon Water-Resistant Orthopedic Foam Pet Crate Mats, announced 2018 [online], [site visited Jan. 22, 2018] Available from Internet URL: <https://www.groupon.com/latest-deals/gg-waterresistant-orthopedic-fo-am-pet-crate-mats>. (2 pages).
Unboxing and Setting Up a Casper Dog Bed, announced Sep. 14, 2016 [online], [site visited Jan. 23, 2018] Available from Internet URL: <https://www.youtube.com/watch?v=fAEKTatzCTA> at approximately 0:48. (1 page).
The Casper Dog Mattress In-depth Review Demo, announced Feb. 15, 2017 [online], [site visited Jan. 23, 2018] Available from Internet URL: <https://www.youtube.com/watch?v=jRgVxs_M35g> at approximately 2:39. (1 page).
EZ Wash Fleece Lounger Poly-Filled Dog Bed, [site visited Jan. 23, 2018] Available from Internet URL: <https://www.wayfair.com/pet/pdp/3-dog-pet-supply-ez-wash-fleecelounger-poly-filled-dog-bed-dpsp1004.html?piid=18825537>. (3 pages).
Luca Crate Cuddler, announced Jul. 15, 2016 [online], [site visited Jan. 23, 2018] Available from Internet URL: <https://www.youtube.com/watch?v=4HeVQP2Z86E> at approximately 0:05. (1 page).
AmazonBasics Padded Pet Bolster Bed, accessed Sep. 16, 2016. (https://www.amazon.com/AmazonBasics-Padded-Pet-Bolster-Bed/

(56) References Cited

OTHER PUBLICATIONS dp/B00QHC06UO- ?ie=UTF8&keywords=dog%20bed&qid=1459134598&ref_=sr_1_11&refinements=p_n_fe- ature_keywords_two_browse-bin%3A8002501011%7C8002502011%7C8002503011&s=pet- -supplies&sr=1-11) (6 pages).
PetCo Sweet Dreams Rectangular Bolster Dog Bed , accessed Sep. 16, 2016 (http://www.petco.com/shop/en/petcostore/dog/dog-beds-and-bedding/dog-bed s/sweet-dreams-rectangular-bolster-dog-bed) (2 pages).
Round Orvis Dog's Nest, accessed Sep. 16, 2016, (http://www.orvis.eom/p/round-orvis-dogs-nest/1h0l) (2 pages).
Frontgate Huggy Nest Pet Bed, accessed Sep. 16, 2016 (http://www.frontgate.com/huggy-nest-pet-bed/pet-products/pet-bedsblankets-throws/bolster-pet-beds/802099), (2 pages).
Petsmart K&H Classy Lounger Pet Bed , accessed Sep. 16, 2016. (http://www.petsmart.com/dog/beds/k-h-classy-lounger-petbed-zid36-26968/- cat-36-catid-100063?var_id=36-26968), (1 page).
Bowsers Super Loft Rectangle Avalon, accessed Sep. 16, 2016 (http://www.bowsers.com/pet-beds/super-loft-rectangle/superloft-rectangle-avalon.html) (1 page).
Petco K&H Deluxe Ortho Bolster Sleeper Dog Bed , accessed Sep. 16, 2016 (http://www.petco.com/shop/en/petcostore/dog/dog-beds-and-bedding/dog-bed- s/kandh-deluxe-ortho-bolster-sleeper-dog-bed-in-eggplant-withpaw-prints# (2 pages).
L.L.Bean Premium Denim Dog Bed Set, Rectangular, accessed Sep. 16, 2016 (http://www.llbean.com/llb/shop/44560?feat=507408-GN2&page=premium-denim-dog-bed-set-rectangular) (3 pages).
Amazon Stainmaster Comfy Couch Pet Bed, accessed Sep. 16, 2016 (https://www.amazon.com/STAINMASTER-Comfy-Couch-Large-Olive/dp/B00LQZ18XQ?ie=UTF8&keywords=dog%20bed&qid=1459135646&ref=sr1 426&refinements=p n feature keywords two browse-bin%3A8002501011%7C8002502011%7C8002503011&s=pet-supplies&sr=1/\26) (8 pages).
Jax & Bones Donut Bed, accessed Sep. 16, 2016 (https://www.jaxandbones.com/products/bedding/donut/licorice-donut-bed) (3 pages).
Petsmart Carolina Pet Orthopedic Comfort Couch, accessed Sep. 16, 2016. http://www.petsmart.com/dog/beds/carolina-petorthopedic-comfort-couch-personalized-pet-bed-zid36-5591/cat-36-catid-100063?var_id=36-5591) (2 pages).
Lux Premium Dog Bed, accessed Sep. 16, 2016 (http://godogbeds.com/product/sample-product-2/) (1 page).
Frontgate Urban Denim Lounger Pet Bed , accessed Sep. 16, 2016 (http://www.frontgate.(X)m/urban-denim-lounger-pet-bed/pet-products/pet-beds-blankets-throws/bolster beds/451775) (3 pages).
Bowsers Donut Bed, accessed Sep. 16, 2016 (http://www.bowsers.com/pet-beds/donut-beds/donut-bed-nickel-weave.html) (1 page).
L.L.Bean Premium Dog Couch, accessed Sep. 16, 2016 (http://www.llbean.com/llb/shop/66388?feat=507408-GN2&page=premium-dog-couch) (3 pages).
Jax & Bones Sleeper Bed, accessed Sep. 16, 2016 (https://www.jaxandbones.com/products/bedding/sleeper/tweed-cremesleeper-bed), (2 pages).
Orvis ToughChew Dog Bed with Polyester Fill, accessed Sep. 16, 2016 (http://www.orvis.com/p/toughchew-rectangle-dogbed/0h4c) (2 pages).
Orvis Wraparound Fleece Dog Bed with Memory Foam, accessed Sep. 16, 2016 (http://www.orvis.com/p/wraparound-fleecedog-bed/2es4) (2 pages).
Orvis Deep Dish Dog Bed with Memory Foam, accessed Sep. 16, 2016 (http://www.orvis.com/p/deep-dish-dog-bed/2c9b) (2 pages).
Bowsers Urban Lounger, accessed Sep. 16, 2016 (http://www.bowsers.com/pet-beds/urban-lounger/urban-loungereverest.html-) (1 page).
Doca pet Zz Bed, accessed Sep. 16, 2016 (https://www.docapet.com/product/zz-bed/) (2 pages).
Jax & Bones Memory Foam Bed, accessed Sep. 16, 2016 (https://www.jaxandbones.com/products/bedding/memory-foam/juniper-memory-foam-pillow) (2 pages).
Orvis Tempur-Pedic.RTM. Deep Dish Dog Bed, accessed Sep. 16, 2016. (http://www.orvis.com/p/orvis-tempur-pedic-deepdish-dog-bed/2gr6) (2 pages).
World of Angus Dog Bed, accessed Sep. 16, 2016, (http://worldofangus.com/collections/the-dog-bed-collection/products/thedog-bed) (4 pages).
Howlpot My Territory, accessed Sep. 16, 2016. (http://www.howlpot.com/product/detail.html?product_no=30&cate_no=1&displ- ay_group=2) (9 pages).
Love Thy Beast Flip Stitch Bed, accessed Sep. 16, 2016 (http://www.lovethybeast.com/collections/sleep/products/flip-stitchbed-grey-blacblack) (7 pages).
Shinola Dolostone Dog Bed, accessed Sep. 16, 2016 (http://www.shinola.com/shop/pet-accessories/dolostone-dogbed.html#color=Ashen%220Gray) (2 pages).
Ruffler Urban Sprawl, accessed Sep. 16, 2016 (http://www.ruffwearcom/Urban-Sprawl-Plush-Dog-Bed?sc=2&category=17) (2 pages).
Marlon Pilvi Cushion http://en.marlonshop.com/product/Pilvi-Cushion/50/?cate_no=1&display_group=2), accessed Sep. 16, 2016 (13 pages).
Downlite Downlite Dream Naturally 300 Thread Count Wool Down Comforter, accessed Jul. 13, 2017 (www.sears.com/downlite-dream-naturally-300-thread-countwool/)-0000000000000000205710000000000000000362141P?plpSellerId=Overstock.com&prdNo=12&blockNo=12&blockType=G 12) (4 pages).
Organic Wool Toddler Pillow, All Natural &100% GOTS Certified Pure Organic, Wool 'Pearls' accessed Jul. 13, 2017 (https://www.amazon.com/Organic-Certified-Antibacterial-Hypoallergenic-Toddlers/dp/B00P6SKT7K) (2 pages).
700 Fill Power Temperature Regulating Down Comforter accessed Jul. 13, 2017 (https://www.cuddledown.com/itemdy00.aspx?ID=70,3276&T1=Z1087+100+10+01) (12 pages).
Hobbs WL90 Count Batting Heirloom Wool, 90"×108" accessed Jul. 13, 2017 (https://www.amazon.com/Hobbs-WL90-Count-Batting-Heirloom/dp/B0063G013G/ref=sr_1_9?e=UTF8&qid=1497374885&sr=8-9&keywords=wool+batting) (1 page).
10" Sewn-Thru Boxstitch PrimaSera Down Alternative Duvet Insert, Tc 230 accessed Jul. 13, 2017 (http://hotelsuppliesdepot.com/10-Sewn-Thm-Boxstitch-PrimaSera-Down-Alternative-DUVET-INSERTTc-230-j 409. html) (1 page).
Badenia 3649730149 Bettcomfort Steppbett, 4-Jahreszeiten, Micro Thermo, 155×220 cm, weiB accessed Jul. 13, 2017 (https://www.amazon.de/Badenia-Bettcomfort-03649730149/\-Jahreszeiten-Steppbett-Thermo/dp/B0026IBFN0/ ef=sr_1_5?=kitchen&ie=UTF8&qid=1460493398&sr=1-5) (1 page).
Office Action and Search Report for China Patent Application No. 201580019495.5 (dated May 3, 2018) (12 pages).
How to set up your dog mattress, no date available (1 page).
Amazon Basics Padded Pet Bolster Bed (https://www.amazon.ram/AmazonBasi/\20bed&qid=1459134598&ref =sr 1 11&refinements=p n feature keywords two browse-bin%3A8002501011% 7C8002502011%7C8002503011 &s=pet-supplies&sr=1 -11), accessed Sep. 16, 2016 (6 pages).
PetCo Sweet Dreams Rectangular Bolster Dog Bed http://www.petco.com/shop/en/pet(X)store/dog/dog-beds-an/\ log-bed), accessed Sep. 16, 2016 (2 pages).
Bowsers Urban Lounger (http://www.bowsers.com/pet-beds/urban-lounger/urban-lounger-everest.html), accessed Sep. 16, 2016 (1 page).
Howlpot My Territory (http://www.howlpot.com/product/detail.html?product_no=30&cate_no=1&display_group=2), accessed Sep. 16, 2016 (9 pages).
Ruffler Urban Sprawl http://www.rufrwear.com/Urban-Sprawl-Plush-Dog-Bed?sc=2&category=17), accessed Sep. 16, 2016 (2 pages).
Design Within Reach, Min Bed, http://www.dwr.com/bedroom-beds/min-bed/6348.html?lang=en_US) (accessed May 23, 2018) (19 pages).
Extended European Search Report issued in EP18192998.5, dated Nov. 20, 2018, 8 pages.
Notice of Allowance dated Nov. 9, 2020 for U.S. Appl. No. 29/700,264 (pp. 1-8).

(56) References Cited

OTHER PUBLICATIONS

Notice of Allowability dated Dec. 9, 2020 for U.S. Appl. No. 29/703,367 (pp. 1-3).

* cited by examiner

MATTRESS CONTAINING ERGONOMIC AND FIRMNESS-REGULATING ENDOSKELETON

REFERENCE TO PRIOR APPLICATIONS

This application claims the benefit of the following two applications, each of which is hereby incorporated by reference in its entirety:

1) U.S. Provisional Application Ser. No. 62/545,445 filed on Aug. 14, 2017; and

2) U.S. Provisional Application Ser. No. 62/637,871 filed on Jul. 13, 2018.

FIELD OF THE DISCLOSURE

The present disclosure relates generally to improved foam mattresses with an elastomer endoskeleton.

BACKGROUND

One of the primary goals of a mattress is to provide the support necessary to enable optimal ergonomic conditions for sleep. The human body's spine must stay in a neutral position when sleeping to prevent stress on joints and muscles. In a side-sleeping position, the spine should be straight when viewed from the side, exhibiting no lateral flexion. In the back-sleeping and stomach-sleeping positions, the spine should be slightly relaxed from its neutral standing position (relaxation is due to gravity unloading of the spine): there should be no kyphosis/lordosis of the lumbar or thoracic spine and no flexion/extension of the cervical spine. Similarly, the body should exhibit no anterior shoulder collapse in the back-sleeping position. FIG. 1 shows an optimal spine position 110; FIG. 2 shows a non-optimal spine position 120.

Unfortunately, it is exceedingly difficult for a mattress to address all these ergonomic requirements across all body types and all sleeping positions (e.g. side, stomach, back) because the body requires different levels of support and pressure relief from head-to-toe and from sleeping position to sleeping position. Nonetheless, the vast majority of mattresses offer a uniform feel head-to-toe and do not account for the unique pressure and support requirements at different parts of the body. Mattresses with strict uniform firmness throughout the mattress cannot achieve the optimal spinal alignment due to the body's variable surface area and weight.

Previous solutions to solve this problem (and their drawbacks) include the following:

A. Zoned Convolution:

Convolution cutting (e.g. egg crate cutting) creates two convolute cut pieces from a single starting piece. Paired, shaped rollers deform the initial foam and force the deformed foam through a fixed, flat cutting blade. Traditional convolute cutting creates an 'egg crate' appearance which softens the foam through material removal. Other shapes (e.g. waves, circles, zig-zags) can be created by varying the roller shape. A single roller can be machined with different zones to create differences in the convolute cut head-to-toe. But the degree of variability in firmness is quite limited due to the limitations of the manufacturing method (50% of the removed material goes to each of the opposing pieces; depth of cuts cannot be varied, etc.), so the observed variation head to toe is quite minimal (typically <10% variation in firmness in the convolute cut foam layer, less in the full mattress).

The downsides of this method also include limited variation and the fact that material removal diminishes mattress durability (due to fact that less material is absorbing wear and tear from use). Further, the downside of this approach is that due to constraints in the convolution, the degree of variation is very limited. The mechanical transition from layer to layer is also limited due to the shapes that can be created in convolution. The process also decreases mattress durability because it relies on material removal to soften the original foam.

B. Zoned Contour:

Contour cutting involves the cutting and removal of foam using a Computer Numerical Control (CNC) saw. This manufacturing process allows the shape of the cuts (including depth, width and shape) to be varied tremendously. Firmness variations of >20% can be achieved through the removal of large amounts of material. But such removal of material can have significant detrimental impact on the durability of the mattress. Further, the process decreases mattress durability because it relies on material removal to soften the original foam.

C. Zoned Foam:

Zoning foam involves the placement of foams of different densities, firmness and/or support factors at different points head-to-toe in the mattress. This increases assembly time and labor costs, so is typically limited to 3-zones. Further, the process is labor intensive and costly. It creates room for error in alignment. And the smoothness of transitions from one zone to the next is limited because the variation is created by blocks of foam that end abruptly at the abutting block.

D. Variable Spring Firmness:

Springs of different spring constant can be placed at different points of the mattress. Spring constant variation can be varied by adjusting alloy, wire diameter, coil count and/or coil diameter, amongst other things. This is most often used to create a border to increase edge support for sitting. But it can also be used to create variable zones of support for sleeping. A downside is that it is limited to spring-based mattresses.

E. Foam Springs:

Cut and formed foam springs that create variable firmness similar to metal springs but with more limited design freedom. The shape of the spring doesn't create any appreciable spring effect other than that inherent in the foam itself. But the forming of the foam spring requires the creation of a lot of void space in the mattress. This forces more wear and tear through the foam that is present, leading to premature softening relative to solid foam. The firmness variation created by the foam springs is also limited to the diameter of the spring itself. Thus, any fine adjustments in firmness head-to-toe is limited by the spring diameter (typically 4-6").

F. Molded Foam Cylinders:

This is forming a mattress core using molded foam cylinders of different firmness. But as with foam springs, the assembly of molded cylinders creates a lot of air space, leading to more wear and tear being absorbed by less material relative to solid foam. They also are typically 4-6" in diameter, limited in the ability to vary firmness.

G. Foam Interlocking:

This is interlocking contour cut foam shapes (puzzle piece-like) to create variable firmness in a mattress. But this process leads to increased waste.

H. 3D Printing:

In this method, an injection head selectively injects polymer into a foam base. But this is a very slow and very expensive manufacturing process and unproven at scale. The printed features are very fine. Further, the molten plastic must flow into the porous/permeable foam, which is an uncontrolled process. Thus, final polymer shape is difficult to control.

SUMMARY

Proposed herein is the inclusion of a shaped elastomer (an "endoskeleton") that variably impacts the mattress firmness head-to-toe. The elastomer fills voids cut into the foam using contour cutting or spherical cap-shaped cutouts. The elastomer is poured as a hot liquid into the voids, and cools to a solid elastomer. The specific incarnation involves the creation of a set of parallel inclusions at the center of the mattress or a set of spherical cap-shaped cutouts that help prop up the hip area to maintain proper spinal alignment by firming the center of the mattress. The depth, width, shape, spacing, elastomer durometer, and location (both head-to-toe and depth in the mattress) may be varied to impact firmness in any desired manner. The inclusion allows near-infinite control over firmness and support at any point in the mattress. The mattress may also include a series of horizontal-oriented cutouts that are cut into various portions of the mattress layers. These cutouts may extend along the width of the mattress and may be placed at portions of the top and portions of the bottom of the mattress. The mattress may also include a series of vertical-oriented holes that cut through one or more layers of the mattress, including the top two layers.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
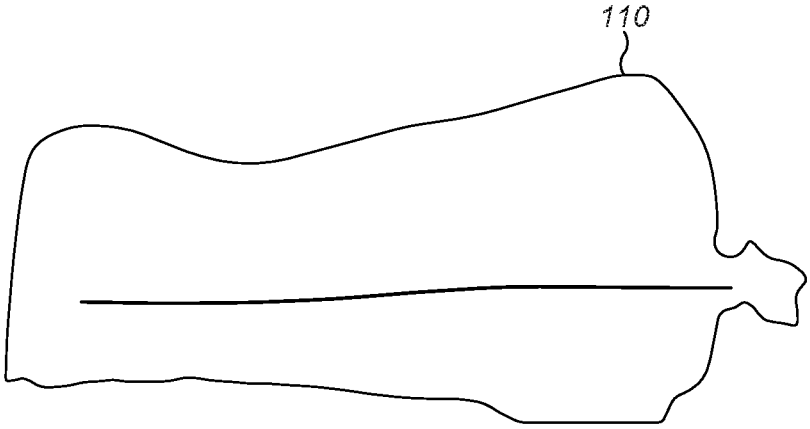
FIG. 1 shows an optimal spine position, in accordance with some embodiments.
Figure 2:
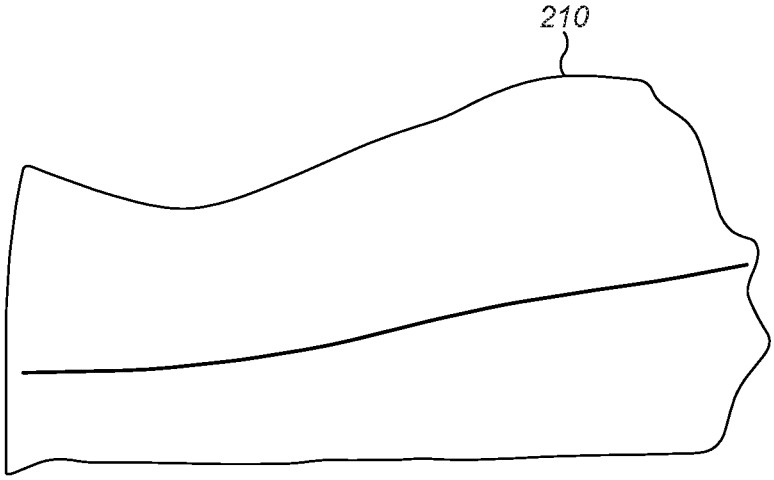
FIG. 2 shows a non-optimal spine position, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be clear to those of ordinary skill in the art having the benefit of the description herein.

DETAILED DESCRIPTION

A mattress with variable support head-to-toe is required to enable proper ergonomics. The ergonomic requirements must also be balanced with other performance requirements of the mattress, many of which are in tension to providing good ergonomics, including:

A. Pressure Relief:

Provide the softness necessary to keep pressure (as measured in pounds per square inch) to minimum levels, eliminating/minimizing pressure points that can cause discomfort and/or disrupt blood flow. This is usually accomplished by distributing the body weight over the maximum surface area possible to reduce pressure.

B. Thermal Comfort:

Allow body heat and moisture (sweat or humidity) to move away from the body (heat can move through conduction, convection or radiation; moisture can move through wicking or evaporation, which is tied to convection).

C. Position Realignment:

Allow the body to easily change positions throughout the night. Pure memory foam mattresses struggle here since sleepers get "stuck" in the cavities that form under the body and it take a lot of energy to move up and out of the cavity into a new position.

D. Partner Isolation:

Minimize the transfer of movement/motion from one partner to the next, so that a partner's position changes do not impact the sleep of the other partner.

E. Durability:

Maintain all the performance characteristics of the new mattress over the full lifetime of the mattress. This is typically measured in changes in firmness (Does the mattress get softer in the areas where the sleeper spends most of their time?) and changes in height (Do valleys or dimples form in the mattress surface?). The performance characteristic that most commonly degrades is the ergonomics due to changes in firmness. It is important to note that all mattresses will show changes in firmness and height over their lifetime; it is just a matter of to what degree, and do the changes observed impact performance.

The solution works by offering zonal firmness to the different parts of the body. The solution provides a counter-pressure that props up the correct parts of the body (e.g. hips) to achieve the optimal ergonomic position. The high elasticity and high Poisson's ratio of the elastomer help reduce pressure points from vertical loads—the elastomer flows outwards when compressed. (Poisson's ratio is a measure of the Poisson effect, the phenomenon in which a material tends to expand in directions perpendicular to the direction of compression.)

The high thermal conductivity and lateral connectivity of the material helps move heat away from the body to improve thermal sleeping comfort.

Figure 3:
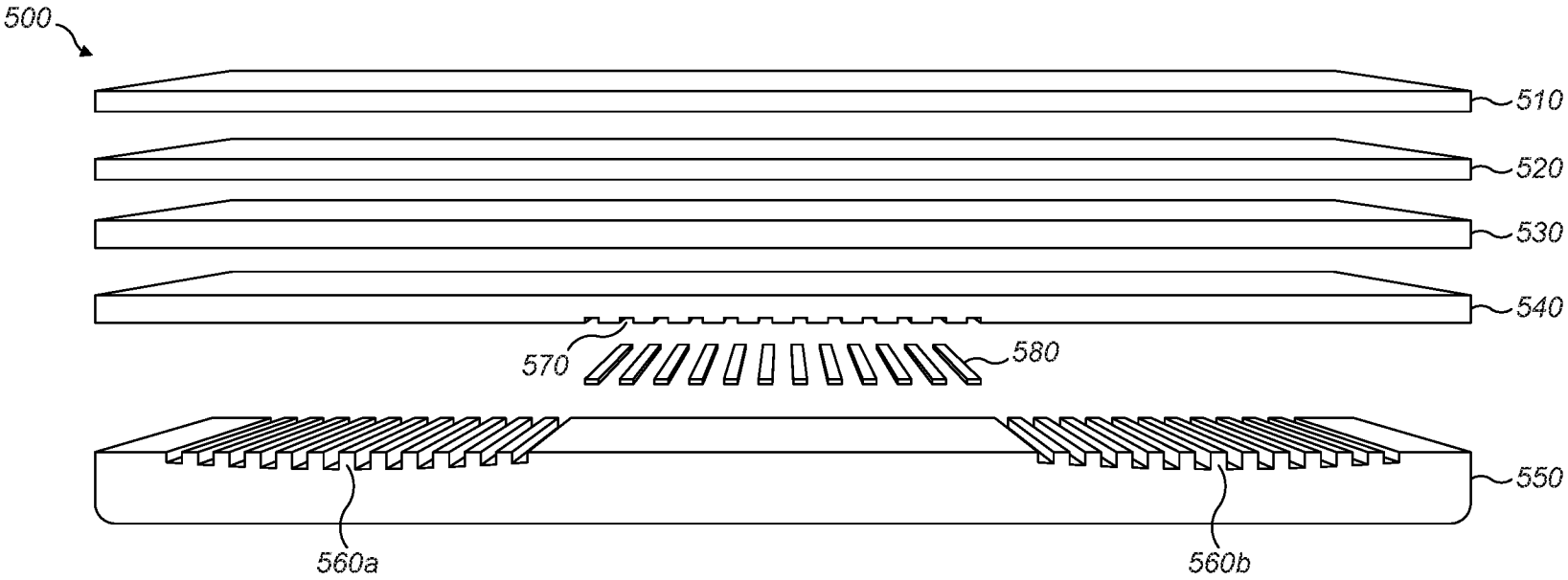
FIG. 3 is an exploded view of a mattress having an endoskeleton with elastomer gel strips, in accordance with some embodiments.

FIG. 3 shows a 5-layer embodiment of a mattress having an endoskeleton with elastomer gel strips 500. The top layer 510 may consist of Flo Soft Foam and have the physical characteristics set forth in Table 1:

TABLE 1

Flo Soft Foam

| Property | Value | Test Method |
|---|---|---|
| Density | 3.0 pcf ± 0.15 | |
| 25% Indentation Force Deflection (IFD) | 6 lb ± 1 | ASTM D3574-11 Test B1 |
| Airflow | >4 ft^3/4 in^2/min | ASTM D3574-11 Test G |
| Recovery | N/A | ASTM D3574-11 Test M |
| Rebound | >20% | ASTM D3574-11 Test H |
| Support Factor | 2.3 ± 0.2 | ASTM D3574-11 Test B1 |
| 75% Compression Set | <2% | ASTM D3574-11 Test D |
| 75% Wet Compression Set | — | ASTM D3574-11 Test D, L |
| Tensile Strength | >30 kPa | ASTM D3574-11 Test E |
| Elongation | >150% | ASTM D3574-11 Test E |
| Constant Deflection Pounding Firmness Loss | <10% | ASTM D3574-11 Test I5, Procedure C |
| Constant Deflection Pounding Height Loss | <2% | ASTM D3574-11 Test I5, Procedure C |

The first layer 510 may have a series of vertical-oriented circular holes that begin at the top of first layer and extend vertically down to the bottom of the second layers (not shown). These holes improve airflow through the mattress.

The second layer 520 may consist of latex and have the physical characteristics set forth in Table 2:

TABLE 2

Latex Foam

| Property | Value | Test Method |
|---|---|---|
| Density | 3.8 pcf ± 0.1 | |
| 25% IFD | 14 lb ± 2 | ASTM D3574-11 Test B1 |
| Airflow | >3 ft^3/4 in^2/min | ASTM D3574-11 Test G |
| Recovery | — | ASTM D3574-11 Test M |
| Rebound | >55% | ASTM D3574-11 Test H |
| Support Factor | 3.1 ± 0.2 | ASTM D3574-11 Test B1 |
| 75% Compression Set | <10% | ASTM D3574-11 Test D |
| 75% Wet Compression Set | — | ASTM D3574-11 Test D, L |
| Tensile Strength | >100 kPa | ASTM D3574-11 Test E |
| Elongation | >300% | ASTM D3574-11 Test E |
| Constant Deflection Pounding Firmness Loss | <15% | ASTM D3574-11 Test I5, Procedure C |
| Constant Deflection Pounding Height Loss | <2% | ASTM D3574-11 Test I5, Procedure C |

The second layer 520 may have a series of circular holes begin at the top of second layer and extend vertically down to the bottom of the second layer (not shown). These holes improve airflow through the mattress. The holes may be positioned so that the holes in the second layer 520 are at approximately the same location of the holes in the first layer 510 so that airflow flows through both layers.

The third layer 530 may consist of visco-elastic foam and have the physical characteristics set forth in Table 3:

TABLE 3

Visco-Elastic Foam

| Property | Value | Test Method |
|---|---|---|
| Density | 3.5 pcf ± 0.2 | |
| 25% IFD | 15 lb ± 2 | ASTM D3574-11 Test B1 |
| Airflow | >2 ft^3/4 in^2/min | ASTM D3574-11 Test G |
| Recovery | 3 sec ± 2 | ASTM D3574-11 Test M |
| Rebound | — | ASTM D3574-11 Test H |
| Support Factor | 2.2 ± 0.2 | ASTM D3574-11 Test B1 |
| 75% Compression Set | — | ASTM D3574-11 Test D |
| 75% Wet Compression Set | — | ASTM D3574-11 Test D, L |
| Tensile Strength | — | ASTM D3574-11 Test E |
| Elongation | — | ASTM D3574-11 Test E |
| Glass Transition Temperature | 50° F. | |
| Constant Force Pounding | — | ASTM D3574-11 TEST I3 |
| Constant Deflection Pounding Firmness Loss | <5% | ASTM D3574-11 Test I5, Procedure C |
| Constant Deflection Pounding Height Loss | <2% | ASTM D3574-11 Test I5, Procedure C |

The fourth layer 540 may consist of high resiliency (HR) foam and have the physical characteristics set forth in Table 4:

TABLE 4

High Resiliency (HR) Foam

| Property | Value | Test Method |
|---|---|---|
| Density | >2.4 minimum | |
| 25% IFD | 29 lb ± 4 lb | ASTM D3574-11 Test B1 |
| Airflow | >0.5 ft^3/4 in^2/min | ASTM D3574-11 Test G |
| Recovery | >35% | ASTM D3574-11 Test M |
| Rebound | >35% | ASTM D3574-11 Test H |
| Support Factor | 2.6 ± 0.2 | ASTM D3574-11 Test B1 |
| 75% Compression Set | <10% | ASTM D3574-11 Test D |
| 75% Wet Compression Set | <15% | ASTM D3574-11 Test D, L |
| 90% Compression Set | <15% maximum | ASTM D3574-11 Test D, L |
| Tensile Strength | — | ASTM D3574-11 Test E |
| Elongation | — | ASTM D3574-11 Test E |
| Constant Deflection Pounding Firmness Loss | <15% | ASTM D3574-11 Test I5, Procedure C |
| Constant Deflection Pounding Height Loss | <2% | ASTM D3574-11 Test I5, Procedure C |

This layer incorporates a series of vertical-shaped cutouts 570 from the bottom of the fourth layer 540 that are filled with a series of elastomer gel strips 580. The series of elastomer gel strips 580 may include gel with a hardness of 20 Shore 00.

The fifth layer 550 may consist of conventional polyurethane foam and have the physical characteristics set forth in Table 5:

TABLE 5

Conventional Polyurethane Foam

| Property | Value | Test Method |
|---|---|---|
| Density | 1.8 pcf ± 0.1 | |
| 25% IFD | 35 lb ± 3 | ASTM D3574-11 Test B1 |
| Airflow | >2 ft^3/4 in^2/min | ASTM D3574-11 Test G |

TABLE 5-continued

| Conventional Polyurethane Foam | | |
|---|---|---|
| Property | Value | Test Method |
| Recovery | — | ASTM D3574-11 Test M |
| Rebound | — | ASTM D3574-11 Test H |
| Support Factor | 2.0 ± 0.2 | ASTM D3574-11 Test B1 |
| 75% Compression Set | <5% | ASTM D3574-11 Test D |
| 90% Compression Set | — | ASTM D3574-11 Test D |
| 75% Wet Compression Set | — | ASTM D3574-11 Test D, L |
| Tensile Strength | — | ASTM D3574-11 Test E |
| Elongation | — | ASTM D3574-11 Test E |
| Constant Force Pounding | — | ASTM D3574-11 TEST I3 |
| Constant Deflection Pounding Firmness Loss | <20% | ASTM D3574-11 Test I5, Procedure C |
| Constant Deflection Pounding Height Loss | <2% | ASTM D3574-11 Test I5, Procedure C |

Figure 5:
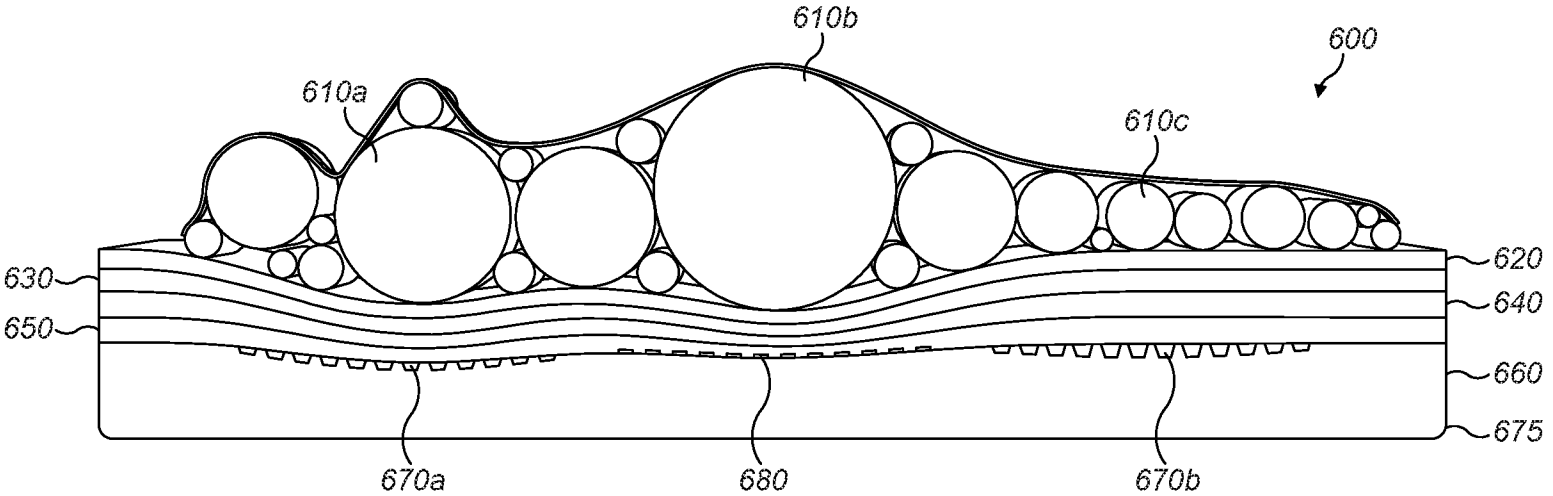
FIG. 5 is a simulated view of a human lying on a mattress having an endoskeleton with elastomer gel strips, in accordance with some embodiments.

This fifth layer 550 includes a series of parallel ridge-shaped cutouts 560*a*, 560*b* from the top of the layer that extend across the width of the mattress. As shown in FIG. 5, the series of parallel ridge-shaped cutouts consists of two sets, one at the top section of the mattress and one at the bottom section, and each set may be symmetrically arranged about the layer with respect to each other. Each set comprises a series of parallel ridge-shaped cutouts of different depths, with the shallowest cutout depth on the outer edges of the set, progressively deeper cutout depths as the cutouts get closer to the center of the set and the deepest cutout depth at the center of the set. The bottom of each parallel ridge-shaped cutout (other than the center cutouts) may also be tilted slightly so that the side farther away from the center has a higher depth than the side closer to the center.

Figure 4:
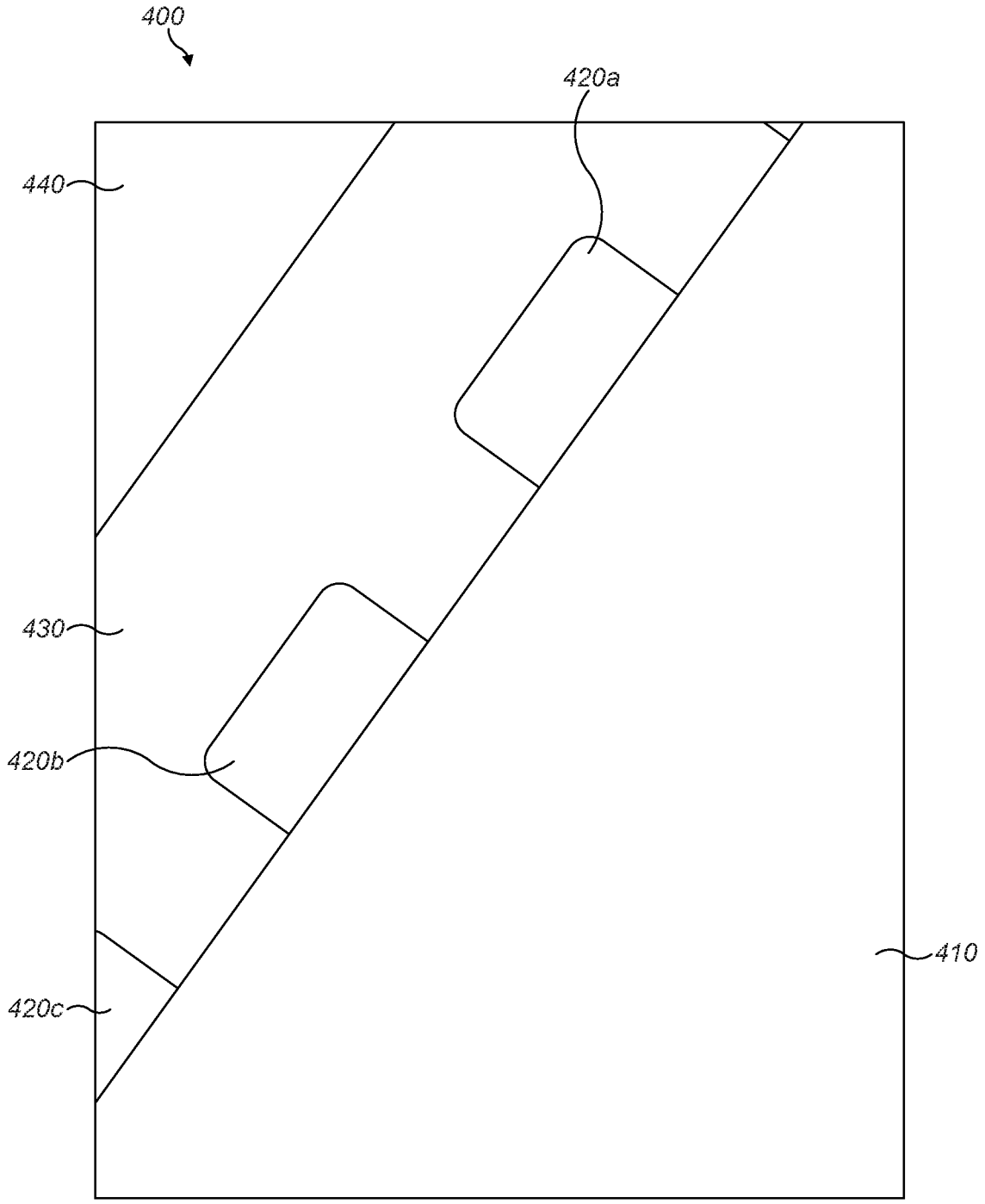
FIG. 4 is a closeup view of a mattress layer having an endoskeleton with elastomer gel strips, in accordance with some embodiments.

Turning to FIG. 4, shown is a detail side view 400 of the mattress. The fourth layer 430 is below the third layer 440 and above the fifth layer 410. The elastomer gel strips 420*a*, 420*b*, 420*c* are wedged into the vertical cutouts in the fourth layer 430. The series of elastomer gel strips 420*a*, 420*b*, 420*c* will allow for different amounts of support and firmness depending on the nature of pressure that will be applied by the person that ultimately uses the mattress.

Turning to FIG. 5, shown is a model 600 with a simulated human having three sections 610*a*, 610*b*, 610*c* lying on a mattress 675 having five layers 620, 630, 640, 650, 660. The fourth layer 650 includes elastomer gel strips wedged into vertical cutouts. The fifth layer 660 includes two sets of empty vertical cutouts 670*a* 670*b*. As can be seen from the model 600, various portions of the human 610*a*, 610*b*, 610*c* provide different levels of downward pressure on the five layers 620, 630, 640, 650, 660 of the mattress 675.

The head and chest area 610*a* may provide a medium level of downward pressure on the mattress 675. Thus, the first set of empty vertical cutout 670*a* in the fifth layer 660 provides a moderate level of support and firmness for the top four layers and the head and chest area 610*a*.

The hip area 610*b* may provide a high level of downward pressure on the mattress 675. Thus, the elastomer gel strips wedged into vertical cutouts in the fourth layer 650 provides a large level of support and firmness for the top three layers and the hip area 610*b*.

The leg area 610*c* may provide a low level of downward pressure on the mattress 675. Thus, the second set of empty vertical cutouts 670*b* in the fifth layer 660 provides a lower level of support and firmness for the top four layers and the leg area 610*c*.

This support system actively mirrors the natural shape of the human body and allows for deeper, more restorative sleep.

Figure 6:
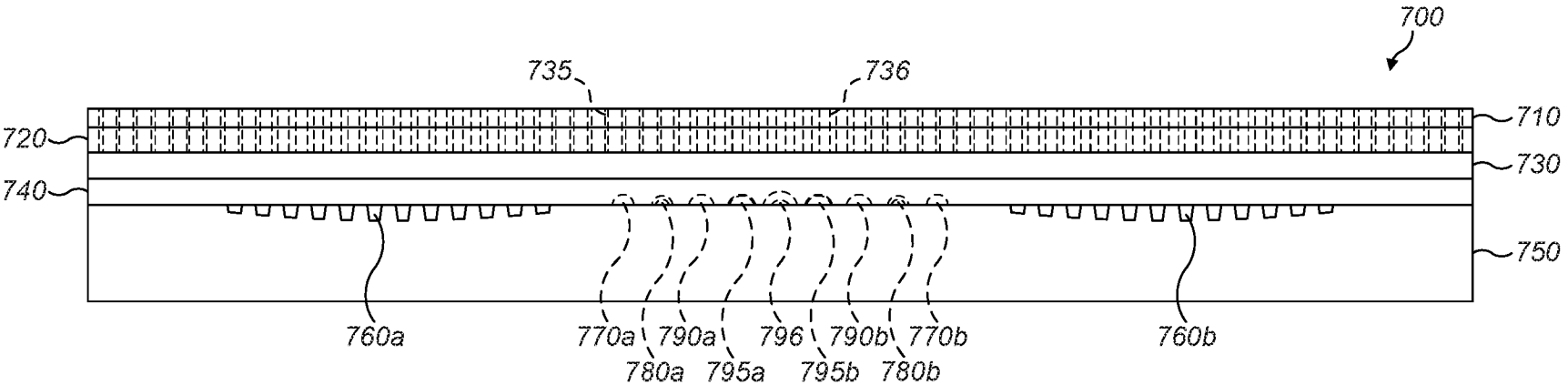
FIG. 6 is a side view of a mattress having an endoskeleton with spherical-cap shaped elastomer gels, in accordance with some embodiments.

Turning to FIG. 6, shown is a side view of an alternative mattress having an endoskeleton with spherical-cap shaped elastomer gels 700. The mattress 700 comprises five layers 710, 720, 730, 740, 750, which may have the same properties as the layers in the other mattress embodiment shown in FIG. 3. The number of layers may be four or less or six or more. A series of vertical holes run from the top of the first layer 710 to the bottom of the second layer 720 to provide for increased airflow. The vertical holes may run through any number of layers. The sizes of the holes may vary across the mattress. The size of the holes may become larger 736 and smaller 735 as a line of holes moves across the length of the mattress.

The fourth layer 740 incorporates a series of spherical-cap shaped cutouts on the bottom of the layer. The smallest spherical-cap shaped cutouts 770*a*, 770*b* run across the width of the mattress and are on the edges of the series. The next-larger spherical-cap shaped cutouts 780*a*, 780*b* run across the width of the mattress and are one step closer to the center of the series. The next-larger spherical-cap shaped cutouts 790*a*, 790*b* run across the width of the mattress and are one step closer to the center of the series. The next-larger spherical-cap shaped cutouts 795*a*, 795*b* run across the width of the mattress and are one step closer to the center of the series. The largest spherical-cap shaped cutout 796 run across the width of the mattress and is at the center of the series. Each of the spherical-cap shaped cutouts may include spherical-cap shaped elastomer gel wedged into the spherical-cap shaped cutout. The gel may have an elastomer with a hardness of 20 Shore 00. The lines of spherical-cap shaped cutouts may be symmetrically positioned about the center width of the fourth layer 740.

The fifth layer 750 includes a series of parallel ridge-shaped cutouts 760*a*, 760*b* from the top of the layer that extend across the width of the mattress. As shown in FIG. 6, the series of ridge-shaped cutouts consists of two sets, one at the top section of the mattress and one at the bottom section, and each set may be symmetrically arranged on the layer with respect to the other set. Each set comprises a series of parallel ridge-shaped cutouts of different depths, with the shallowest cutout depth on the outer edges of the set, progressively deeper cutout depths as the cutouts get closer to the center of the set and the deepest cutout depth at the center of the set. The bottom of each parallel ridge-shaped cutout (other than the center cutouts) may also be tilted slightly so that the side farther away from the center has a higher depth than the side closer to the center.

Figure 7:
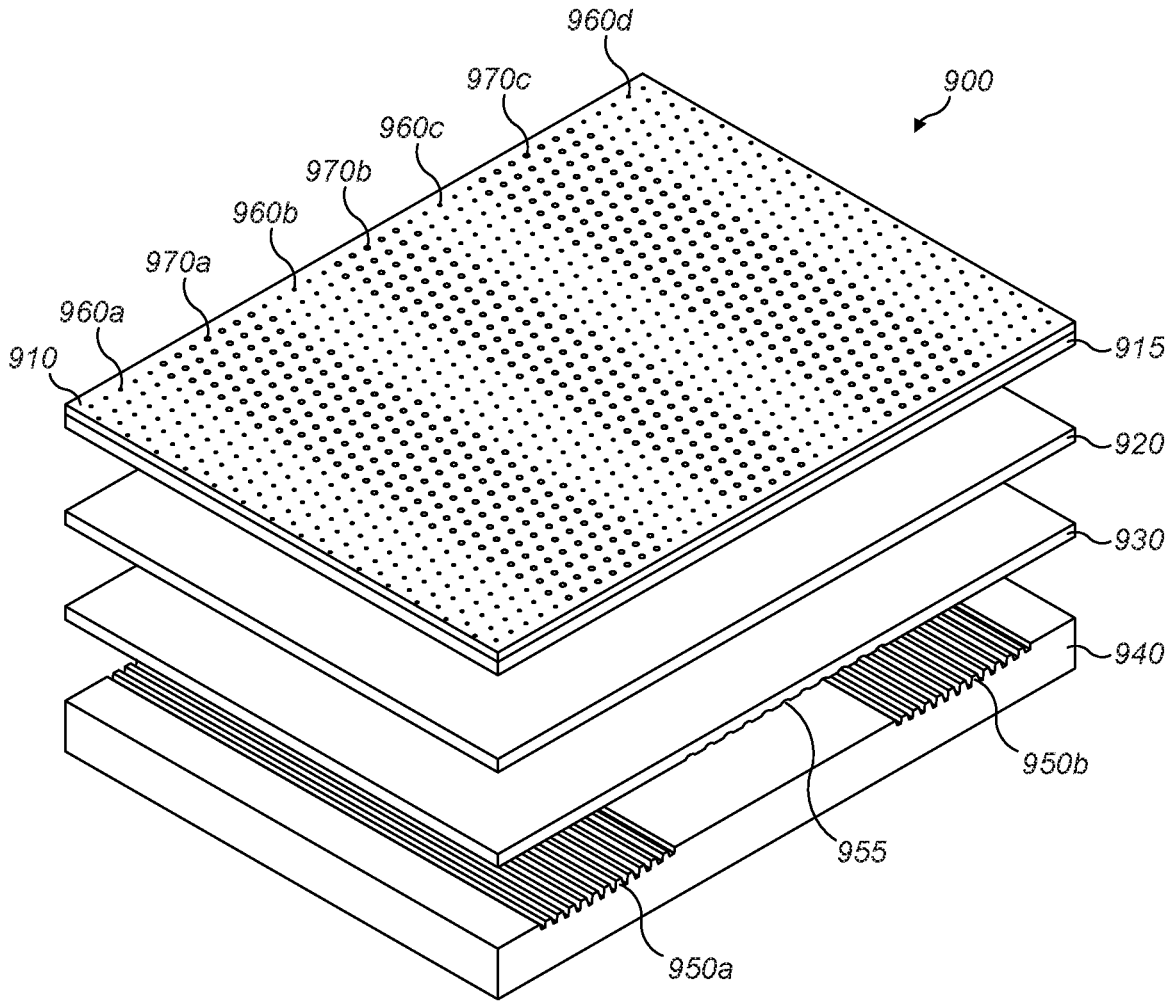
FIG. 7 is an exploded view of a mattress having an endoskeleton with spherical-cap shaped elastomer gels, in accordance with some embodiments.

Turning to FIG. 7, shown is an exploded view of the 5-layer mattress having an endoskeleton with spherical-cap shaped elastomer gels 900. The mattress 900 comprises five layers 910, 915, 920, 930, 940, which may have the same properties as the layers in the other mattress embodiment shown in FIG. 3 and described in Tables 1, 2, 3, 4 and 5. The number of layers may be four or less or six or more.

A series of vertical holes run from the top of the first layer 910 to the bottom of the second layer 915 to provide for increased airflow. The sizes of the holes may vary across the mattress. The size of the holes may become larger 970*a*, 970*b*, 970*c* and smaller 960*a*, 960*b*, 960*c*, 960*d* as a line of holes moves across the length of the mattress. In addition, one row of hole patterns across the length of the mattress may be slightly offset from the adjoining rows of hole patterns across the length of the mattress.

The fourth layer 930 incorporates a series of spherical-cap shaped cutouts 955. Each of the spherical-cap shaped cutouts may include gel, and the gel may have an elastomer with a hardness of 20 Shore 00.

The fifth layer 940 includes a series of parallel ridge-shaped cutouts 950*a*, 960*b* from the top of the layer that extend across the width of the mattress. As shown in FIG. 6, the series of parallel ridge-shaped cutouts consists of two sets, one at the top section of the mattress and one at the bottom section, and each set may be symmetrically arranged on the layer with respect to the other set. Each set comprises a series of parallel ridge-shaped cutouts of different depths, with the shallowest cutout depth on the outer edges of the set, progressively deeper cutout depths as the cutouts get closer to the center of the set and the deepest cutout depth at the center of the set. The bottom of each parallel ridge-shaped cutout (other than the center cutouts) may also be tilted slightly so that the side farther away from the center has a higher depth than the side closer to the center.

The advantages described with respect to a human lying on the mattress in FIG. 5 (having an endoskeleton with elastomer gel strips) also apply to the mattress in FIGS. 6 and 7 (having an endoskeleton with spherical-cap shaped elastomer gels). The advantages described with respect to the vertical holes in the mattress in FIGS. 6 and 7 (having an endoskeleton with spherical-cap shaped elastomer gels) apply equally to the mattress in FIG. 5 (having an endoskeleton with elastomer gel strips).

Figure 8A:
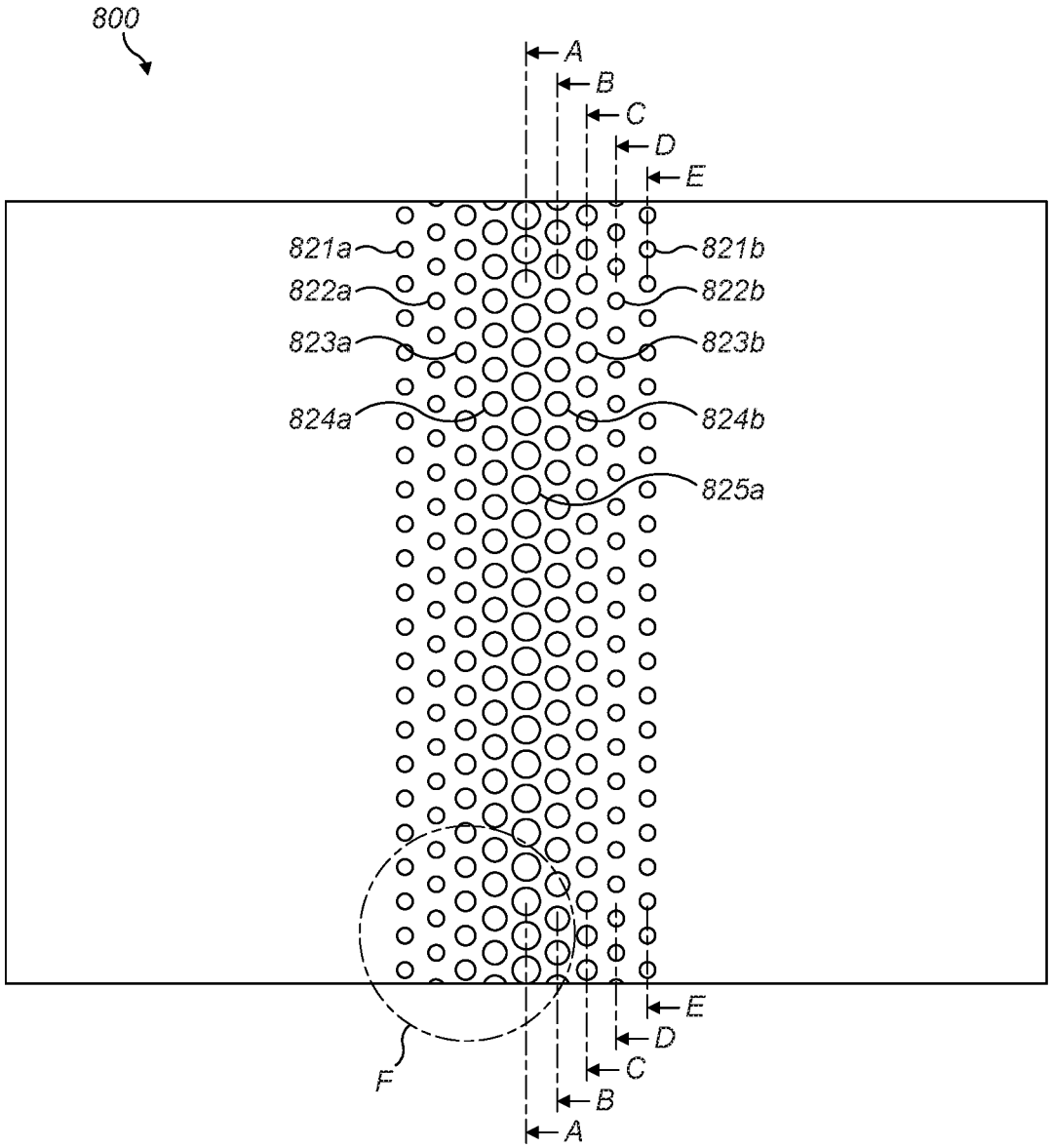
FIG. 8A is an overhead view of the bottom side of a mattress layer with spherical-cap shaped elastomer gels, in accordance with some embodiments.
Figure 8B:
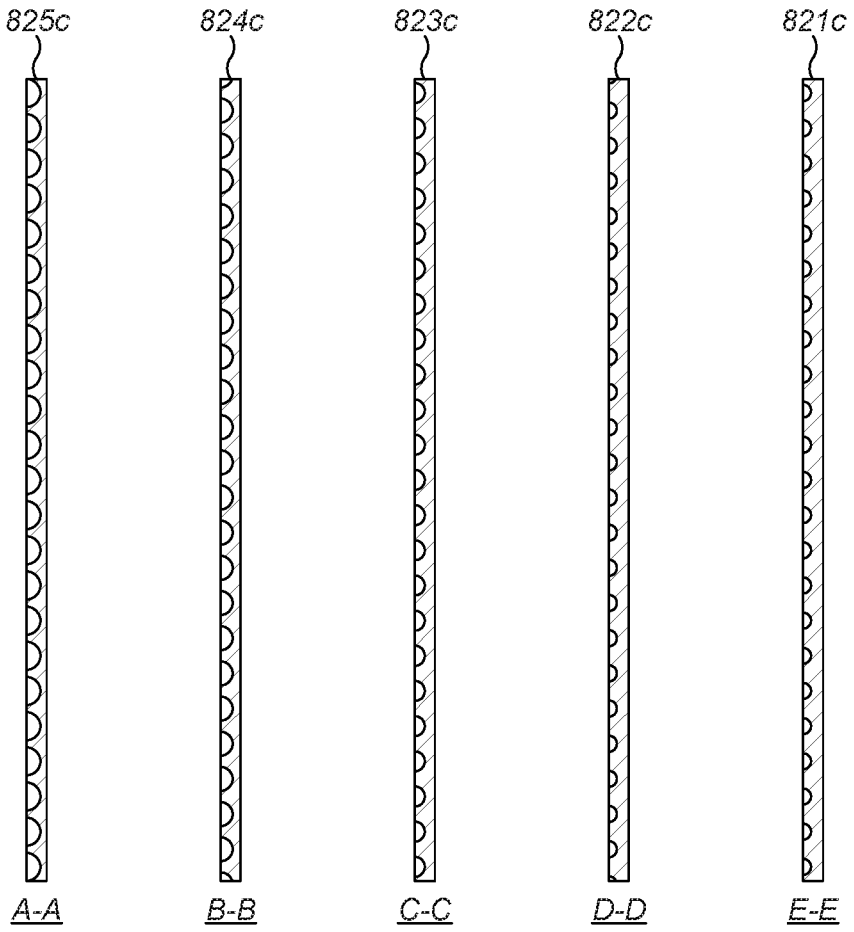
FIG. 8B shows a plurality of cross-sections of the mattress layer shown in FIG. 8A, in accordance with some embodiments.
Figure 8C:
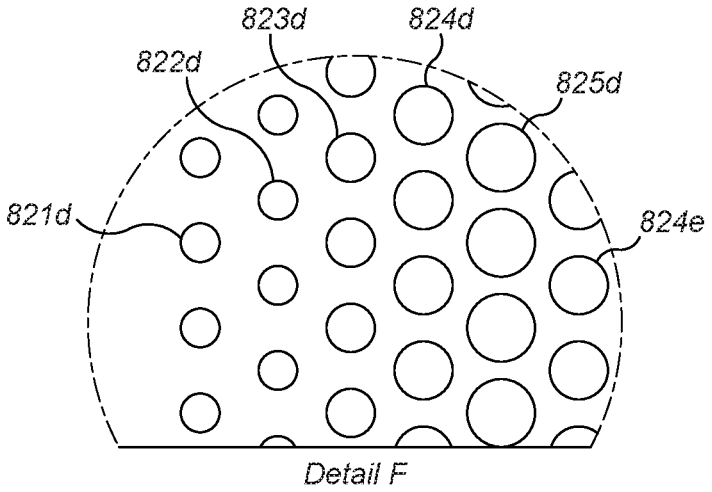
FIG. 8C is a close-up view of the bottom side of the mattress layer shown in FIG. 8A, in accordance with some embodiments.

Turning to FIGS. 8A, 8B and 8C shown is more detail of one arrangement 800 of the spherical-cap shaped cutouts that are filled with gel. The arrangement may be located on the bottom of the fourth layer 740 shown in FIG. 6 and may be located on the high resiliency foam layer.

This arrangement 800 comprises a plurality of lines of spherical-cap shaped cutouts that run across the width of the high-resiliency foam layer. In this arrangement there are 9 such lines (although any other number may be used). The spherical-cap shaped cutouts may be filled with gel and the gel may have an elastomer with a hardness of 20 Shore 00.

The center line (A) has the largest spherical-cap shaped cutouts 825*a*. A cross section A-A 825*c* in FIG. 8B shows the deepest shaped cutouts. An overhead detail F in FIG. 8C shows the largest spherical-cap shaped cutouts 825*d*.

The lines immediately adjacent to the center line on the left and on the right (B) have the next-smaller spherical-cap shaped cutouts 824*a*, 824*b*. A cross section B-B 824*c* in FIG. 8B shows the next-shallower spherical-cap shaped cutouts. An overhead detail F in FIG. 8C shows the next-smaller spherical-cap shaped cutouts 824*d*, 824*e*.

The lines immediately adjacent to the previously-discussed line on the left and on the right (C) have the next-smaller spherical-cap shaped cutouts 823*a*, 823*b*. A cross section C-C 823*c* in FIG. 8B shows the next-shallower spherical-cap shaped cutouts. An overhead detail F in FIG. 8C shows the next-smaller spherical-cap shaped cutouts 823*d*.

The lines immediately adjacent to the previously-discussed line on the left and on the right (D) have the next-smaller spherical-cap shaped cutouts 822*a*, 822*b*. A cross section D-D 822*c* in FIG. 8B shows the next-shallower spherical-cap shaped cutouts. An overhead detail F in FIG. 8C shows the next-smaller spherical-cap shaped cutouts 823*d*.

The lines immediately adjacent to the previously-discussed line on the left and on the right (E) have the smallest spherical-cap shaped cutouts 821*a*, 821*b*. A cross section D-D 821*c* in FIG. 8B shows the shallowest spherical-cap shaped cutouts. An overhead detail F in FIG. 8C shows the smallest spherical-cap shaped cutouts 821*d*.

The pattern of spherical-cap shaped cutouts along the lines may have different offsets across the width of the mattress. As shown in FIGS. 8A, 8B and 8C, this may be arranged so that every other line (such as A, C and E) have a first offset pattern. The other lines (such as B and D) have a second offset pattern.

Other incarnations of the mattress may include one or more of the following:

A. The endoskeleton inclusion can take near any shape (parallel, transverse, at angle, or any combination therein) relative to the body. It can have straight or curved shapes.

B. The inclusion can be placed at any height or depth of the mattress and can cover from 1% to 100% of the mattress footprint (when viewed from above).

C. The inclusion can be combined with foam subtraction/cutouts at other points of the mattress to create wider spreads in firmness. Or it can be standalone without any other foam subtraction/cutouts.

D. The inclusion can soften or firm up the mattress, or both, depending on the location.

E. The inclusion can create variable firmness from left-to-right across the mattress.

F. The inclusion can be facing different layers of the mattress in any combination.

G. The inclusion can be silicone, polyurethane or another elastomer. It can be foamed or solid.

H. The inclusion can be poured in liquid state into the foam, or it can be performed into a shape via injection molding, RIM molding, compression molding, extrusion or other manufacturing method that yields a shaped elastomer.

I. The inclusion could also be rigid (plastic, rubber or other material) such that it has an elongation less than 20% before it no longer recovers to original shape.

J. The inclusion could be a fabric textile bonded to the foam layers.

K. The inclusion could be an air or liquid bladder.

L. The inclusion can fill a shaped void in the foam (formed through cutting, convoluting, molding or other means) or it can be in-situ, filling the pores of the foam. Or it can be both.

M. The inclusion may be externally affixed to the mattress and help define the external surfaces of the mattress. In this case, it would be an "exoskeleton."

N. The inclusion can be designed in such a way that the firmness or thermal conductivity of the inclusion can be varied thru air pressure, electricity, magnetism, temperature or other external force or field.

O. The inclusion can include additives to improve thermal conductivity.

P. The inclusion can be for mattresses, seats, cushions, pads, or any other comfort product.

Q. The number of layers in the mattress may vary in number and in composition and may include one or more of the layers with the physical properties specified in Tables 1, 2, 3, 4, 5. The cutouts may be taken from one or more of the layers. The inclusion may be embedded in one or more of the layers.

R. The mattress may also include a series of vertical-oriented holes that cut through one or more layers of the mattress, including the top two layers.

S. The inclusion may be made of various sizes of spherical-cap shaped cutouts arranged in varying orders.

Thus, the use of an elastomer endoskeleton in a foam mattress to create variable firmness has the following advantages:

A. It can create much greater differences in firmness.

B. It increases durability (as it is a net additive process, not subtractive).

C. It can achieve much a greater range of shapes.

D. It can include a filler (e.g., temperature modification) that can be modified to any preference to increase sleep quality.

E. It has high elasticity and Poisson's ratio that reduces pressure points in comparison to foams.

F. It increases thermal conductivity that moves heat away from body.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, various features are grouped together in various embodiments for streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. A mattress comprising:

a plurality of foam layers, wherein the plurality of foam layers include a first foam layer and a second foam layer;

wherein the first foam layer has a first foam layer bottom;

wherein the first foam layer includes a plurality of spherical cap-shaped cutouts from the first foam layer bottom;

wherein the second foam layer has a second foam layer top, a second foam layer width, a second foam layer first half, and a second foam layer second half;

wherein the second foam layer first half and the second foam layer second half run across the second foam layer width; and wherein the second foam layer includes a plurality of horizontal-oriented cutouts from the second foam layer top;

wherein the first foam layer is above the second foam layer;

wherein the plurality of horizontal-oriented cutouts run across the second foam layer width;

wherein the plurality of horizontal-oriented cutouts comprise a first cutout set and a second cutout set;

wherein the first cutout set runs across the second foam layer width within the second foam layer first half;

wherein the second cutout set runs across the second foam layer width within the second foam layer second half;

wherein the first cutout set and the second cutout set are symmetrically arranged about the second foam layer with respect to each other;

wherein the first cutout set comprises a first series of parallel ridge-shaped cutouts and wherein the second cutout set comprises a second series of parallel ridge-shaped cutouts;

wherein the first series of parallel ridge-shaped cutouts has a shallowest cutout depth on an outer edge of the first series, progressively deeper cutout depths as cutouts get closer to the center of the first series, and a deepest cutout depth at the center of the first series;

wherein the second series of parallel ridge-shaped cutouts has a shallowest cutout depth on an outer edge of the second series, progressively deeper cutout depths as cutouts get closer to the center of the second series, and a deepest cutout depth at the center of the second series.

2. The mattress as in claim 1, wherein the first cutout set and the second cutout set provide support and firmness for those foam layers within the plurality of foam layers that are above the first layer.

3. The mattress as in claim 1, wherein the second layer comprises polyurethane foam.

4. The mattress as in claim 1 wherein a bottom of each parallel ridge-shaped cutout other than a center cutout is tilted slightly so that a side farther away from the center cutout has a higher depth than a side closer to the center cutout.

5. A mattress comprising:

a plurality of foam layers, wherein the plurality of foam layers include a first foam layer and a second foam layer;

wherein the first foam layer has a first foam layer bottom, a first foam layer width and a first foam layer center width;

wherein the second foam layer has a second foam layer top;

wherein the first foam layer includes a plurality of spherical cap-shaped cutouts from the first foam layer bottom;

wherein the plurality of spherical cap-shaped cutouts are each filled with elastomer gel; and wherein the second foam layer includes a plurality of horizontal-oriented cutouts from the second foam layer top;

wherein the first foam layer is above the second foam layer;

wherein the plurality of horizontal-oriented cutouts run across the first foam layer width;

wherein the plurality of horizontal-oriented cutouts run across the second foam layer width;

wherein the plurality of horizontal-oriented cutouts comprise a first cutout set and a second cutout set;

wherein the first cutout set runs across the second foam layer width within the second foam layer first half;

wherein the second cutout set runs across the second foam layer width within the second foam layer second half;

wherein the first cutout set and the second cutout set are symmetrically arranged about the second foam layer with respect to each other;

wherein the first cutout set comprises a first series of parallel ridge-shaped cutouts and wherein the second cutout set comprises a second series of parallel ridge-shaped cutouts;

wherein the first series of parallel ridge-shaped cutouts has a shallowest cutout depth on an outer edge of the first series, progressively deeper cutout depths as cutouts get closer to the center of the first series, and a deepest cutout depth at the center of the first series;

wherein the second series of parallel ridge-shaped cutouts has a shallowest cutout depth on an outer edge of the second series, progressively deeper cutout depths as cutouts get closer to the center of the second series, and a deepest cutout depth at the center of the second series.

6. The mattress as in claim 5, wherein the plurality of spherical cap-shaped cutouts comprise a plurality of lines of spherical-cap shaped cutouts that run across the first foam layer width.

7. The mattress as in claim 6, wherein the plurality of lines of spherical-cap shaped cutouts are symmetrically positioned about the first foam layer center width.

8. The mattress as in claim 7, wherein the center line of the plurality of lines of spherical-cap shaped cutouts comprises the largest-sized spherical-cap shaped cutouts within the plurality of spherical cap-shaped cutouts.

9. The mattress as in claim 7, wherein the lines of the plurality of lines of spherical-cap shaped cutouts that are furthest from the center line comprises the smallest-sized spherical-cap shaped cutouts within the plurality of spherical cap-shaped cutouts.

10. The mattress as in claim 7, wherein the first foam layer comprises high resiliency foam.

11. The mattress as in claim 7, wherein the plurality of spherical cap-shaped cutouts provide support and firmness for those foam layers within the plurality of foam layers that are above the first layer.

12. The mattress as in claim 5, wherein a bottom of each parallel ridge-shaped cutout other than a center cutout is tilted slightly so that a side farther away from the center cutout has a higher depth than a side closer to the center cutout.

13. A mattress comprising:

a plurality of foam layers, wherein the plurality of foam layers include a first foam layer and a second foam layer;

wherein the first foam layer has a first foam layer bottom, a first foam layer width and a first foam layer center width;

wherein the second foam layer has a second foam layer top, a second foam layer width, a second foam layer first half, and a second foam layer second half;

wherein the first foam layer is above the second foam layer;

wherein the first foam layer includes a plurality of spherical cap-shaped cutouts from the first foam layer bottom;

wherein the plurality of spherical cap-shaped cutouts are each filled with elastomer gel;

wherein the second foam layer includes a plurality of horizontal-oriented cutouts from the second foam layer top that run across the second foam layer width;

wherein the plurality of horizontal-oriented cutouts comprise a first cutout set and a second cutout set;

wherein the first cutout set runs across the second foam layer width within the second foam layer first half;

wherein the second cutout set runs across the second foam layer width within the second foam layer second half;

wherein the first cutout set and the second cutout set are symmetrically arranged about the second foam layer with respect to each other;

wherein the first cutout set comprises a first series of parallel ridge-shaped cutouts and wherein the second cutout set comprises a second series of parallel ridge-shaped cutouts;

wherein the first series of parallel ridge-shaped cutouts has a shallowest cutout depth on an outer edge of the first series, progressively deeper cutout depths as cutouts get closer to the center of the first series, and a deepest cutout depth at the center of the first series;

wherein the second series of parallel ridge-shaped cutouts has a shallowest cutout depth on an outer edge of the second series, progressively deeper cutout depths as cutouts get closer to the center of the second series, and a deepest cutout depth at the center of the second series.

14. The mattress as in claim 13, wherein the plurality of spherical cap-shaped cutouts comprise a plurality of lines of spherical-cap shaped cutouts that run across the first foam layer width.

15. The mattress as in claim 14, wherein the plurality of lines of spherical-cap shaped cutouts are symmetrically positioned about the first foam layer center width.

16. The mattress as in claim 15, wherein the plurality of foam layers comprises at least one foam layer above the first layer including a series of vertical-oriented holes.

17. The mattress as in claim 15, wherein the first foam layer comprises high resiliency foam and the second foam layer comprises polyurethane foam.

18. The mattress as in claim 13, wherein a bottom of each parallel ridge-shaped cutout other than a center cutout is tilted slightly so that a side farther away from the center cutout has a higher depth than a side closer to the center cutout.

* * * * *